US008303217B2

(12) United States Patent
Jinnings et al.

(10) Patent No.: US 8,303,217 B2
(45) Date of Patent: Nov. 6, 2012

(54) SYSTEMS FOR THE SUBTERRANEAN SUPPORT OF UNDERGROUND CONDUITS

(75) Inventors: John W. Jinnings, Leo, IN (US); Robert J. Wegener, McHenry, IL (US)

(73) Assignee: Terra Technologies, LLC, Mettenry, IL (US)

( * ) Notice: Subject to any disclaimer, the term of this patent is extended or adjusted under 35 U.S.C. 154(b) by 248 days.

(21) Appl. No.: 12/488,049

(22) Filed: Jun. 19, 2009

(65) Prior Publication Data

US 2010/0074690 A1 Mar. 25, 2010

Related U.S. Application Data

(60) Provisional application No. 61/100,010, filed on Sep. 25, 2008, provisional application No. 61/169,805, filed on Apr. 16, 2009.

(51) Int. Cl.
*F16L 3/00* (2006.01)

(52) U.S. Cl. ..... 405/184.4; 405/157

(58) Field of Classification Search ..... 405/118, 405/184.4, 157, 132, 141, 145, 146; 404/2, 404/4; 248/87, 58, 59; 52/39, 58, 59
See application file for complete search history.

(56) References Cited

U.S. PATENT DOCUMENTS

| | | | | |
|---|---|---|---|---|
| 1,637,586 | A | | 8/1927 | Pates |
| 1,689,678 | A | | 10/1928 | Mauterer |
| 2,121,291 | A | | 6/1938 | Habe |
| 2,210,788 | A | | 8/1940 | Anderson |
| 2,908,140 | A | | 10/1959 | Everson, Jr. |
| 4,730,427 | A | | 3/1988 | Tomsin |
| 4,917,543 | A | | 4/1990 | Cole et al. |
| 5,085,539 | A | | 2/1992 | Massarsch |
| 5,154,539 | A | | 10/1992 | McCown, Sr. et al. |
| 5,213,438 | A | * | 5/1993 | Barenwald ..... 404/2 |
| 5,659,985 | A | | 8/1997 | Stump |

(Continued)

FOREIGN PATENT DOCUMENTS

FR 2 789 096 8/2000

(Continued)

OTHER PUBLICATIONS http://www.answers.com/topic/between.*

(Continued)

*Primary Examiner* — Frederick L Lagman
*Assistant Examiner* — Sean Andrish
(74) *Attorney, Agent, or Firm* — Scherrer Patent & Trademark Law, P.C.; Stephen T. Scherrer

(57) ABSTRACT

The present invention relates to a support system for supporting a conduit. In one exemplary embodiment, the system includes support beams extending across an excavated opening. For example, a pair of beams may be positioned to span the excavated opening with the opposing ends of the beams supported on the ground above the excavated opening. Support rods may be positioned to extend through and/or from the beams and into the excavated opening. In one exemplary embodiment, the support rods include a J-hook configured for receipt within an opening in sections of curved sheet pile positioned beneath a conduit. By using a plurality of rods, the individual sections of curved sheet pile may be connected to the beams to provide a support structure for the curved sheet pile and, correspondingly, the conduit extending above the curved sheet pile and below the beam.

13 Claims, 18 Drawing Sheets

U.S. PATENT DOCUMENTS

| | | | | |
|---|---|---|---|---|
| 6,140,819 | A | 10/2000 | Peterman et al. | |
| 6,273,641 | B1 | 8/2001 | Bull | |
| RE37,661 | E | 4/2002 | Raunisto | |
| 6,437,726 | B1 | 8/2002 | Price | |
| 6,575,663 | B2 | 6/2003 | Kostelnik et al. | |
| 6,710,741 | B2 | 3/2004 | Tucker | |
| 6,715,964 | B2 | 4/2004 | Nottingham | |
| 6,735,888 | B2 | 5/2004 | Green et al. | |
| 6,751,553 | B2 | 6/2004 | Young et al. | |
| 6,758,634 | B2 | 7/2004 | Nickelson et al. | |
| 6,851,890 | B2 | 2/2005 | Kostelnik et al. | |
| 6,975,942 | B2 | 12/2005 | Young et al. | |
| 7,062,414 | B2 | 6/2006 | Waite et al. | |
| 7,113,124 | B2 | 9/2006 | Waite | |
| 7,175,369 | B2 | 2/2007 | Fomenkov et al. | |
| 7,400,976 | B2 | 7/2008 | Young et al. | |
| 2003/0145570 | A1* | 8/2003 | Berndt et al. | 56/6 |
| 2004/0208708 | A1 | 10/2004 | Nottingham | |
| 2004/0208710 | A1 | 10/2004 | Shreider et al. | |
| 2004/0265068 | A1 | 12/2004 | Guedes De Melo et al. | |
| 2006/0193701 | A1 | 8/2006 | Nottingham | |
| 2008/0075540 | A1* | 3/2008 | Kim | 405/276 |
| 2009/0057521 | A1 | 3/2009 | Bootsman | |

FOREIGN PATENT DOCUMENTS

| | | |
|---|---|---|
| JP | 3-279516 | 12/1991 |
| NL | 8501196 | 11/1986 |
| NL | 9402133 | 7/1996 |

OTHER PUBLICATIONS

Foreign patent document with English language abstract.
European Search Report dated Nov. 26, 2009 in corresponding European Application No. 09011983.5.
EP Search Report dated Dec. 9, 2009 in corresponding EP Application No. 09011981.9.
EP Search Report dated Nov. 5, 2009 in corresponding EP Application No. 09011982.7.

* cited by examiner

SYSTEMS FOR THE SUBTERRANEAN SUPPORT OF UNDERGROUND CONDUITS

CROSS-REFERENCE TO RELATED APPLICATIONS

This application claims the benefit under Title 35 U.S.C. §119(e) of U.S. Provisional Patent Application Ser. No. 61/100,010, entitled METHOD AND APPARATUS FOR SUBTERRANEAN SUPPORT OF UNDERGROUND CONDUITS, filed on Aug. 25, 2008, and U.S. Provisional Patent Application Ser. No. 61/169,805, entitled SHEET PILING AND METHODS FOR THE SUBTERRANEAN SUPPORT OF UNDERGROUND CONDUITS, filed on Apr. 16, 2009, the entire disclosures of which are expressly incorporated by reference herein.

BACKGROUND

1. Field of the Invention

The present invention relates to sheet pile, systems, and methods for the subterranean support of underground conduits.

2. Description of the Related Art

Particularly in urban environments, when it is necessary to lay water or sewer pipe, construction crews will often encounter buried electrical, telephone, and/or fiber optic cables. These cables are typically encased in a conduit structure, such as a clay tile or raceway that has a plurality of longitudinal holes through which the cables are pulled. In order to create a unitary subterranean support structure for the cables, individual raceway sections are placed end-to-end and mortared together. In order to lay another conduit, such as water or sewer pipes that must be buried below the freeze line, it is necessary to excavate beneath the raceway and the cables contained therein. When excavation occurs beneath the raceway, the raceway must be supported to prevent the raceway from collapsing into the excavated hole.

Currently, in order to support the raceway during and after excavation, the individual raceway tiles are jack hammered, causing the raceway tiles to break apart and expose the cables positioned therein. The exposed cables are then supported by one or more beams extending above the excavated hole. Once the water or sewer pipe is laid, the hole is backfilled and a concrete form is built around the cables. The form is filled with concrete and the concrete is allowed to harden. As a result, the cables are encased within the concrete and are protected from future damage. While this process is effective, it is also time consuming and expensive. Additionally, once the cables are encased in concrete, it is no longer possible to pull new cables through the raceway or to easily extract existing cables from the raceway.

SUMMARY

The present invention relates to sheet pile, systems, and methods for the subterranean support of underground conduits. For purposes of the present invention, the term "conduit" includes elongate structures, such as raceways or conduits for wires, cables and optical fibers, pipes, cables, and the like. In one exemplary embodiment, the present invention includes a plurality of individual curved sheet piles that are positioned beneath an underground conduit, such as a raceway, to support the conduit during excavation. In one exemplary embodiment, the individual sections of curved sheet pile are interfit and/or interconnected. This allows the individual sections to work in combination with one another to support the conduit. Specifically, opposing ends of a length of interfit and/or interconnected curved sheet piles extend into unexcavated soil on both sides of an excavated hole to form a bridge across the hole that supports the conduit and any soil or other subterranean material positioned above the curved sheet pile.

In one exemplary embodiment, each section of curved sheet pile includes a flange extending from the lower surface of the curved sheet pile. In this embodiment, the flange extends beyond the edge of the curved sheet pile and forms a support surface configured to support an adjacent section of curved sheet pile. The flange has a radius of curvature substantially identical to the radius of curvature of the curved sheet pile. In this manner, with a first section of curved sheet pile positioned beneath a conduit, a second section of curved sheet pile may be advanced beneath the conduit at a position adjacent to the first section of curved sheet pile, such that the lower surface of the second section of curved sheet pile is positioned atop and supported by the support surface of the flange of the first section of curved sheet pile to form a junction between the first and second sections of curved sheet pile. This process can then be repeated until enough sections of curved sheet pile have been positioned beneath the conduit to sufficiently span the excavation site.

By positioning and supporting the lower surface of the second section of curved sheet pile atop the support surface of the first section of curved sheet pile, the flange of the first section of curved sheet pile acts as a seal to prevent the passage of subterranean material between the adjacent sections of curved sheet pile. In addition, the flange of the first section of curved sheet pile provides a guide to facilitate alignment of the second section of curved sheet pile during insertion and also compensates for misalignment of the second section of curved sheet pile relative to the first section of curved sheet pile.

In another exemplary embodiment, each section of curved sheet pile includes a first flange extending from the lower surface of the curved sheet pile and extending beyond a first edge of the curved sheet pile and a second flange extending from the upper surface of the curved sheet pile and extending beyond a second, opposing edge of the curved sheet pile. With this configuration, adjacent sections of curved sheet pile may be interfit with one another. For example, the edge of a first section of curved sheet pile having a flange extending from a lower surface of the first section of curved sheet pile is positioned to extend beneath a second section of curved sheet pile along the edge of the second section of curved sheet pile that has a flange extending from its upper surface. By positioning the first and second sections of curved sheet pile in this manner, the flange of the first section of curved sheet pile will extend beneath and support the second section of curved sheet pile, while the flange extending from the second section of curved sheet pile will extend over the upper surface of the first section of curved sheet pile. In this manner, an interfitting connection is formed between the adjacent sections of curved sheet pile.

Advantageously, by using sections of curved sheet pile with each section having a first flange extending from the lower surface of the curved sheet pile and extending beyond a first edge of the curved sheet pile and a second flange extending from the upper surface of the curved sheet pile and extending beyond a second, opposing edge of the curved sheet pile, the flanges add width to the curved sheet pile that prevents the passage of subterranean material between adjacent sections of the curved sheet pile, facilitate alignment of adjacent sections of curved sheet pile, and prevent the formation of a gap between adjacent sections of curved sheet pile. In addition, the first section of curved sheet pile that is inserted may be gripped and inserted from either of its two opposing sides. Further, these sections of curved sheet pile provide for an interconnection and interlocking between adjacent sections of curved sheet pile that facilitates the transfer of loading between adjacent sections of the curved sheet pile. This allows the individual sections of curved sheet pile to cooperate and act as a unitary structure for supporting a conduit. Further, by acting as a unitary structure, the sections of curved sheet pile may be substantially simultaneously lifted without the need to lift each individual section of curved sheet pile independently. The flanges also stiffen the individual sections of curved sheet pile, which makes the individual sections more resistant to bending during insertion.

In another exemplary embodiment, the curved sheet pile may include a plate secured to an upper surface of the curved sheet pile and extending between opposing edges thereof. The plate extends from upper surface of the curved sheet pile in a radially inwardly direction toward the center of the radius of curvature of the curved sheet pile. The plate is positioned adjacent to the end of the curved sheet pile that is gripped during the insertion of the curved sheet pile beneath the conduit. In this manner, the plate acts to push subterranean material that falls onto the curved sheet pile during insertion of the curved sheet pile back into position beneath the conduit. This prevents the loss of a substantial amount of subterranean material during insertion of the curved sheet pile and helps to facilitate the support of the conduit by the curved sheet pile by compacting the subterranean material.

Once a plurality of sections of curved sheet pile have been inserted beneath a conduit and connected to one another, such as with interfitting flanges, the curved sheet pile may be connected to a support system including support beams extending across the excavated opening. For example, a pair of beams may be positioned to span the excavated opening with the opposing ends of the beams supported on the ground above the excavated opening. Support rods may be positioned to extend through and/or from the beams and into the excavated opening. In one exemplary embodiment, the support rods include a J-hook configured for receipt within an opening the curved sheet pile. In one exemplary embodiment, the J-hooks are inserted through the openings in the curved sheet pile in a first orientation and are then rotated ninety degrees to position a portion of the curved sheet pile on the J-hook. By using a plurality of rods, the individual sections of curved sheet pile may be connected to the beams to provide a support structure for the curved sheet pile and, correspondingly, the conduit extending above the curved sheet pile and below the beam.

In one exemplary embodiment, curved sheet pile is driven underneath an existing conduit using a pile driver guided hydraulically by an excavator or other heavy machinery. For purposes of the present invention, the phrase "pile driver" includes vibratory pile drivers, impact pile drivers, hydraulic pile drivers, and hydrostatic jacking mechanisms. By vibrating the curved sheet piles, the soil is placed in suspension, which allows the piles to be directed through the soil along an arcuate path that has a curvature that substantially matches the radius of curvature of the piles. In one exemplary embodiment, the pile is inserted along an arcuate path substantially automatically by using a machine control program that controls the position of the curved sheet pile during insertion into the soil. Once the pile is positioned as desired, each individual pile sheet can be welded to another to form a unitary structure. Additionally, as indicated above, the curved sheet piles may have interconnecting features that interlock with one another to secure adjacent sections of pile to one another.

In one exemplary embodiment, the curved sheet pile is inserted beneath a conduit using a vibratory pile driver that rotates about a fixed pivot element on an excavator or other heavy machine for positioning the pile driver to advance the curved sheet pile along a fixed arc. Preferably, the distance between the fixed pivot element and clamps that secure the curved sheet pile to the pile driver is the same as the radius of curvature of the curved sheet pile. When the curved sheet pile is secured to the pile driver by the clamps, the center of the radius of curvature of the curved sheet pile lies substantially on the rotational axis of the fixed pivot element. As a result, the curved sheet pile may be advanced beneath a conduit, such as a raceway, without the need to move or further adjust the position of either the articulated boom of the excavator or the vibratory pile driver during placement of the curved sheet pile. By limiting the movement of the vibratory pile driver to rotation about a fixed pivot element during insertion of the curved sheet pile, the need for the operator of the excavator to simultaneously adjust the elevation and/or alignment of the vibratory pile driver during insertion of the curved sheet pile is eliminated.

Advantageously, by utilizing curved sheet pile, the need to jackhammer a conduit, such as a raceway or otherwise destroy the conduit to expose and support wires or other items extending through the conduit is eliminated. The curved sheet pile also provides for pyramidic loading, i.e., the curved sheet pile forces the subterranean material inward toward the center of the radius of curvature of the curved sheet pile, that helps to prevent the subterranean material above the curved sheet pile from collapsing. Further, use of curved sheet pile to support a conduit does not prevent the subsequent pulling or extraction of wires or other items through the conduit. Moreover, the present method also reduces both the cost and time necessary to support the conduit during excavation.

In one form thereof, the present invention provides a support system for supporting a conduit positioned underground including a section of curved sheet pile adapted to be driven underneath a conduit buried underground. The section of curved sheet pile includes a body having an upper surface, a lower surface, a gripping edge, a leading edge, and opposing side edges extending between the gripping edge and the leading edge. The body has a body radius of curvature extending between the gripping edge and the leading edge. The gripping edge, the leading edge, and the opposing side edges cooperate to define a perimeter of the body. The curved sheet pile also includes a first flange extending from one of the opposing sides of the body and the first flange offset from the upper surface of the body. The support system further includes at least one elongate suspension member having a pile connection end and a beam end. The pile connection end is configured for securement to the section of curved sheet pile. The support system has at least one beam, wherein the beam connection end of the elongate suspension member is configured for securement to the at least one beam.

In another form thereof, the present invention provides a support system for supporting a conduit positioned underground, including a section of curved sheet pile adapted to be driven underneath a conduit buried underground. The section of curved sheet pile includes a body having an upper surface, a lower surface, a gripping edge, a leading edge, and opposing side edges extending between the gripping edge and the leading edge. The body has a body radius of curvature extending between the gripping edge and the leading edge, with the gripping edge, the leading edge, and the opposing side edges cooperating to define a perimeter of the body. At least one opening is positioned adjacent to the gripping edge of the body and extends between the upper surface and the lower surface of the body. At least one opening is positioned adjacent to the leading edge of the body and extends between the upper surface and the lower surface of the body. The support system also includes at least one elongate suspension member that has a pile connection end and a beam end. The pile connection end is configured to pass through the openings in the curved sheet pile for securement of the elongate suspension member to the section of curved sheet pile. And, the support system includes at least one beam, wherein the beam connection end of the elongate suspension member is connectable to the at least one beam.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
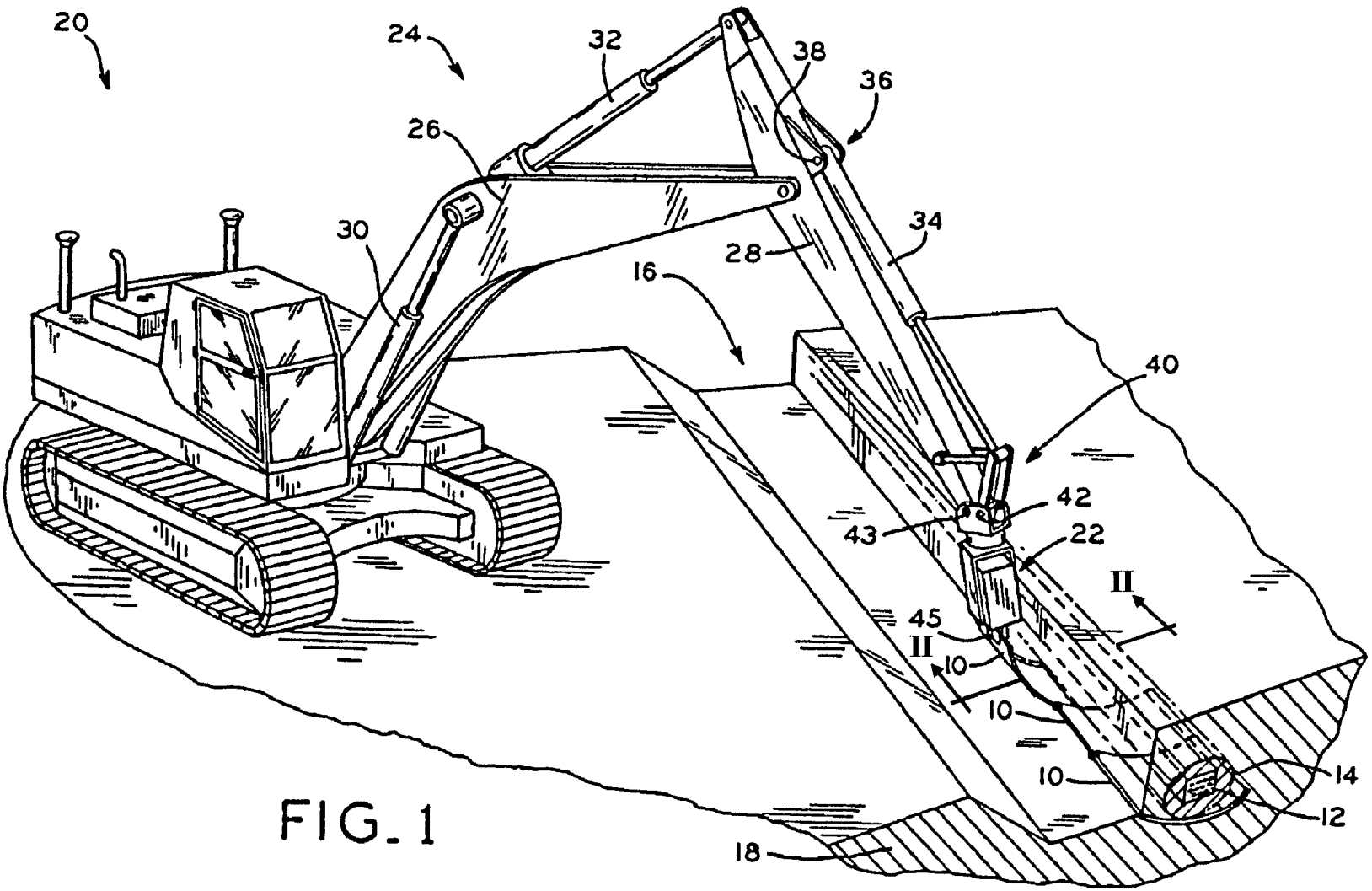
FIG. 1 is perspective view of an excavator with a vibratory pile driver according to an exemplary embodiment of the present invention inserting a curved sheet pile beneath a conduit.

Referring to FIG. 1, the installation of a plurality of sections of curved sheet pile 10 beneath conduit 12 is shown. As shown in the figures, conduit 12 is depicted as being a raceway, which has a plurality of openings extending along its longitudinal axis for the receipt of wires, cables, or other types of conduit therethrough. However, while shown herein as a raceway, conduit 12 may be any type of conduit, such as a gas line, an oil line, an individual wire or bundle of wires, a fiber optic line or bundle of fiber optic lines, a sewer line, a gas line, a fuel line, an electric line, an aqueduct, a phone line, and/or any other type of known conduit or a combination thereof. Exclusion zone 14, as described in detail below, extends around conduit 12 by a predetermined distance and defines an area that curved sheet pile 10 should not enter during insertion. For example, an electronic control system, such as the control system described below, may be used to facilitate the insertion of curved sheet pile 10 and may be programmed to stop the insertion of curved sheet pile 10 if the control system determines that continued movement of curved sheet pile 10 may result in curved sheet pile 10 entering exclusion zone 14.

As shown in FIG. 1, trench 16 is dug adjacent to conduit 12 to provide access to the soil adjacent to conduit 12. Curved sheet pile 10 is inserted into soil or other subterranean material 18 using excavator 20 and vibratory pile driver 22. Excavator 20 includes articulated boom 24 having arms 26, 28 that are actuated by cylinders 30, 32, respectively. Articulated boom 24 also includes hydraulic cylinder 34 connected to arm 28 at first end 36 by pin 38 and connected to pile drive 22 at second end 40 by pin 42. Pile driver 22 is also connected to arm 28 of articulated boom 24 by pin 43, which defines a first fixed pivot element about which pile driver 22 may be rotated relative to articulated boom 24 and arm 28. As shown, pile driver 22 is a vibratory pile driver. In this embodiment, pile driver 22 may include a vibration generator, such as vibration generator 58 described in detail below, that generates vibrations in the direction of arrow A of FIG. 2.

While described and depicted herein as a vibratory pile driver, pile driver 22 may be a non-vibratory pile driver that relies substantially entirely on hydraulic force to advance curved sheet pile 10 into subterranean material 18. In one exemplary embodiment, pile driver 22 relies on the hydraulic fluid pumped by excavator 20 to drive curved sheet pile 10 into subterranean material 18. Further, while described and depicted herein as being used in conjunction with excavator 20, any of the pile drivers disclosed herein, such as pile driver 22, may be used in conjunction with any heavy machinery capable of lifting the pile driver and providing hydraulic fluid thereto. In other embodiments, the pile drivers disclosed herein may be used with heavy machinery that does not supply hydraulic fluid to the pile drivers, but, instead, relies on a separate pump system to provide hydraulic fluid to the pile drivers. Additionally, pile driver 22 may be manipulated independently of excavator 20 and may incorporate features of pile driver 52 described in detail below.

Figure 2:
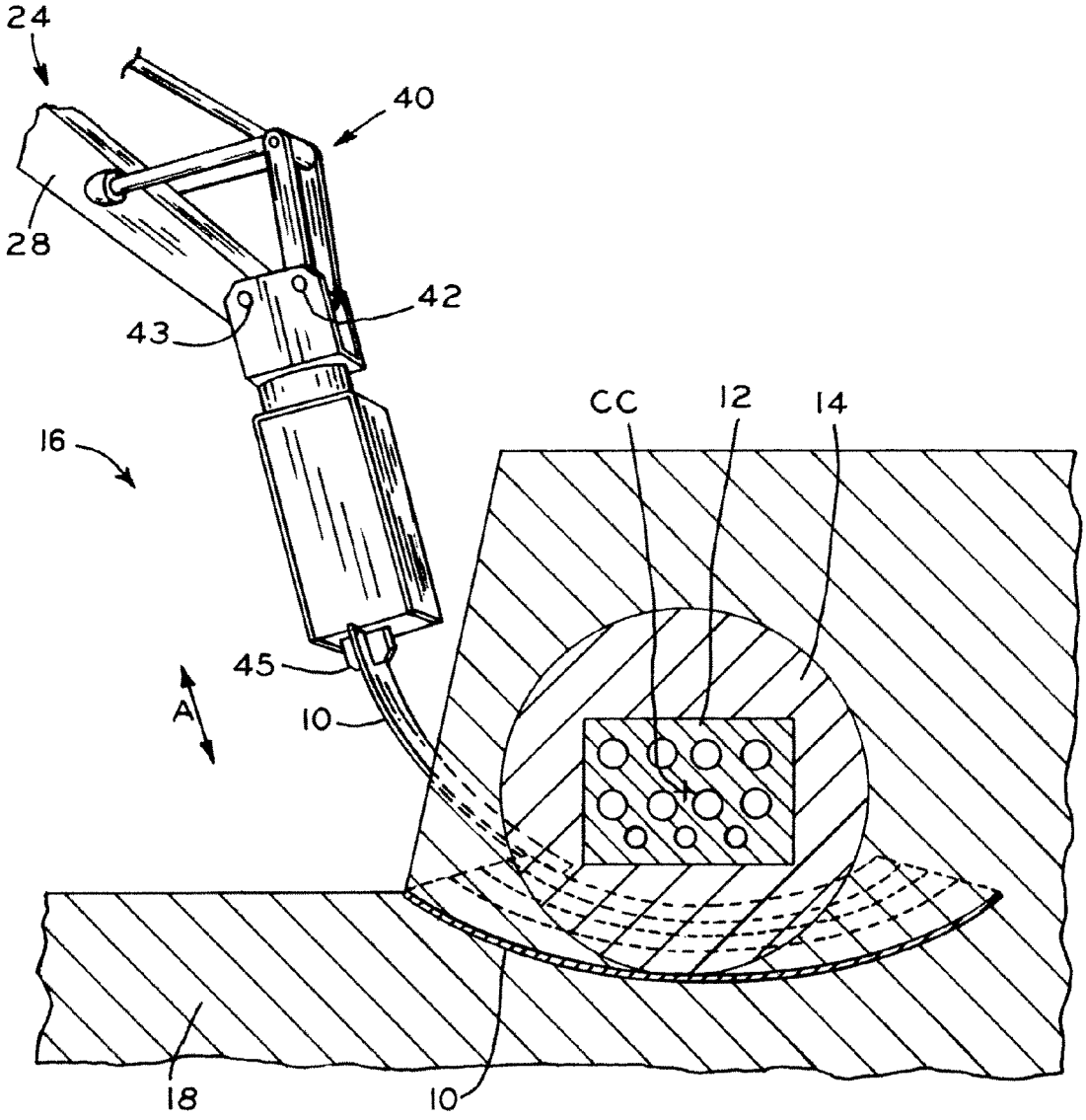
FIG. 2 is a fragmentary, partial cross-sectional view of the pile driver, excavator, curved sheet pile, and conduit of FIG. 1.
Figure 3:
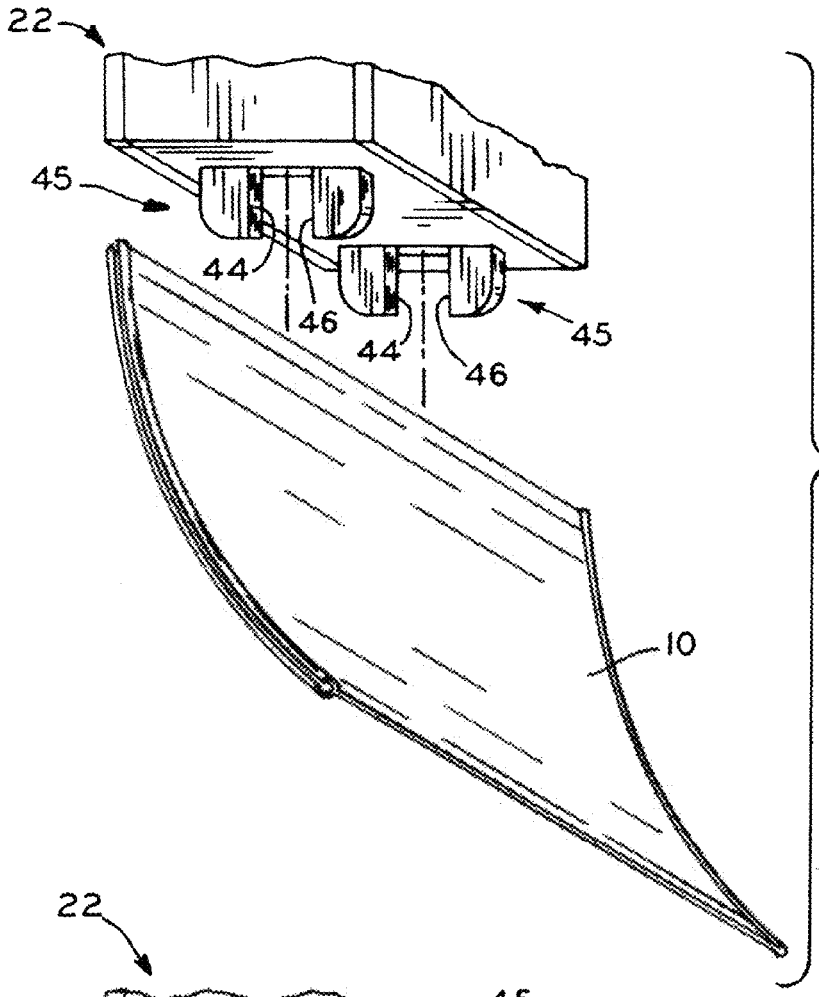
FIG. 3 is a fragmentary perspective view of the pile driver of FIG. 1 positioned adjacent a section of curved sheet pile.
Figure 4:
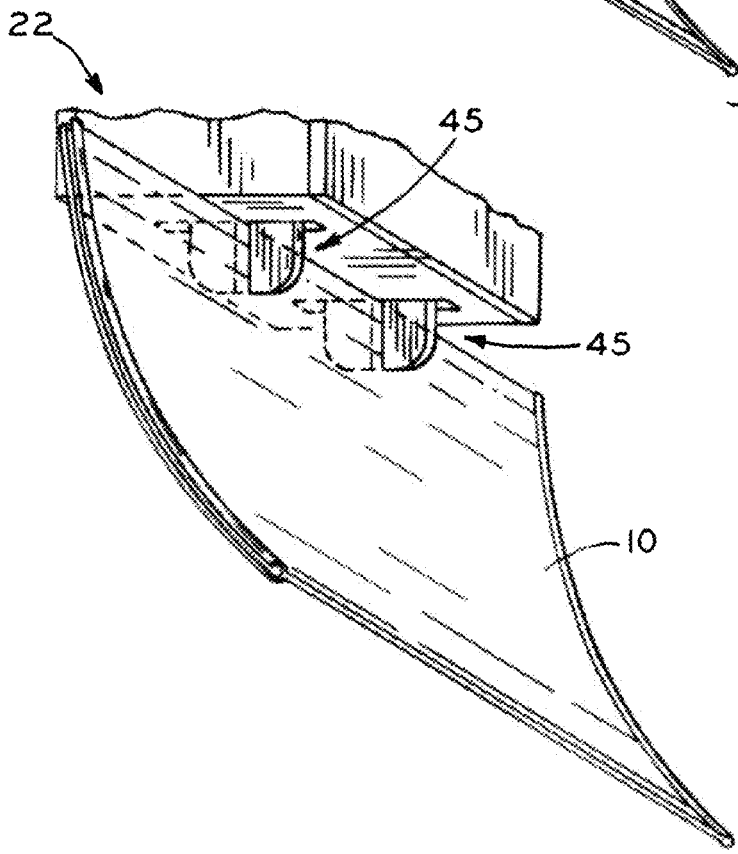
FIG. 4 is a fragmentary perspective view of the vibratory pile driver of FIG. 3 grasping the curved sheet pile of FIG. 3.
Figure 6:
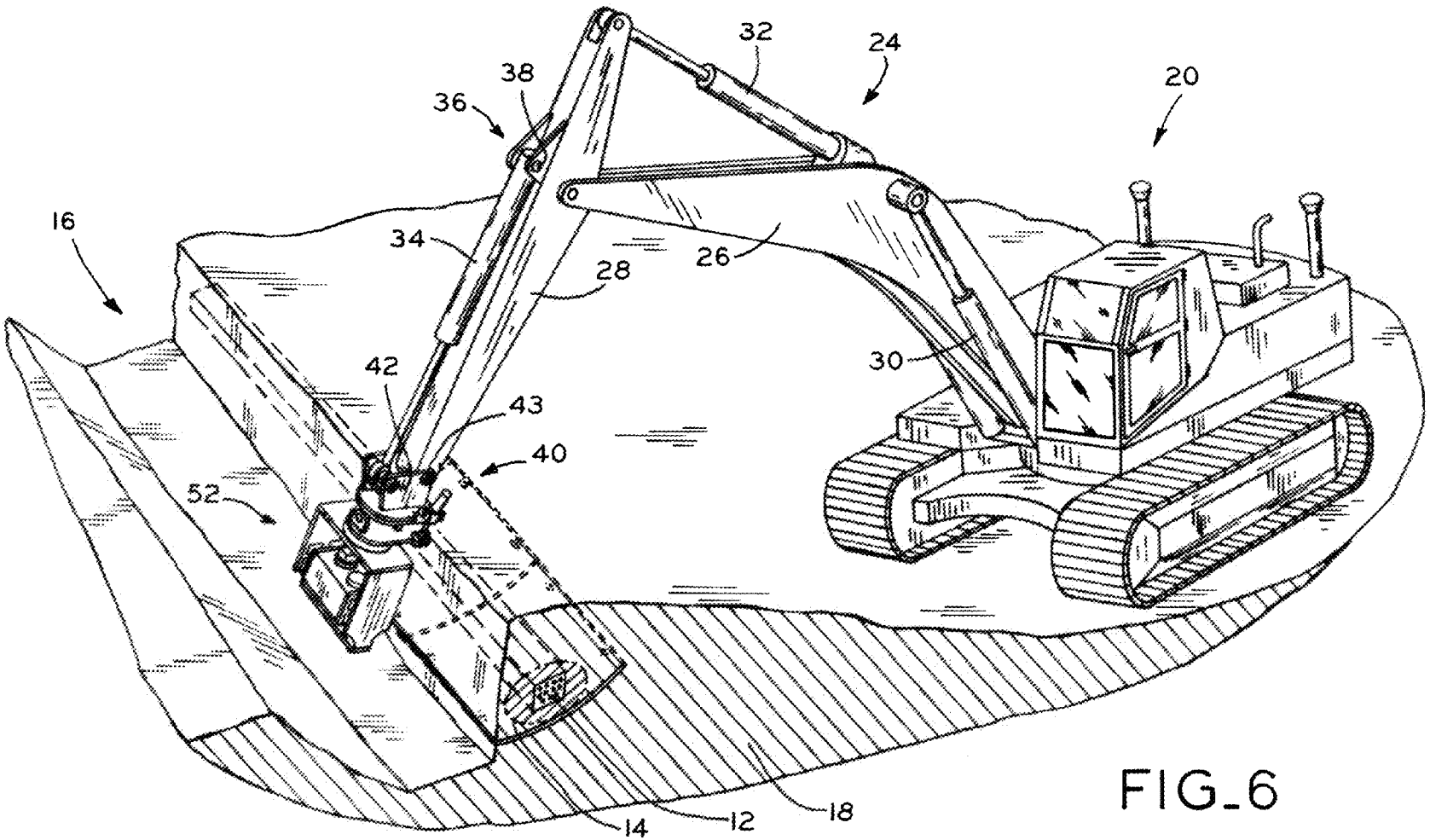
FIG. 6 is a perspective view of an excavator with a vibratory pile driver according to another exemplary embodiment inserting a section of curved sheet pile beneath a conduit.

As shown in FIGS. 2 and 3, front grip vibratory pile driver 22 includes clamps 45 having opposing clamp surfaces 44, 46. Although excavator 20 is shown in a position whereby it drives the sheet pile 10 away from it, an opposite orientation wherein the excavator is positioned on the other side of the conduit 12 and drives the sheet pile 10 toward it is also possible, and is in fact, preferable, as shown in FIG. 6 with respect to pile driver 52. Referring to FIG. 3, two clamps 45 having opposing clamp surfaces 44, 46 are shown in the open position and are ready to receive a section of curved sheet pile 10. Referring to FIG. 4, a section of curved sheet pile 10 is positioned within the opening between the opposing clamp surfaces 44, 46. With curved sheet pile 10 in this position, at least one of the opposing clamp surfaces 44, 46 of each clamp 45 is actuated toward the other clamp surface 44, 46, to clamp curved sheet pile 10 therebetween. In one exemplary embodiment, clamps 45 are actuated hydraulically in a known manner.

Returning to FIG. 1, with an individual section of curved sheet pile 10 held by clamps 45 of vibratory pile driver 22, excavator 20 may be operated to insert curved sheet pile 10 into position within subterranean material 18 and beneath conduit 12. This may be achieved by actuating curved sheet pile 10 along an arc having a radius of curvature that is substantially similar to the radius of curvature of curved sheet pile 10, as described in detail below. As shown in FIG. 1, in one exemplary embodiment, curved sheet pile 10 is positioned at a distance from conduit 12 outside of exclusion zone 14. Once in this position, pile driver 22 may be manipulated by excavator 20 to advance curved sheet pile 10 along an arc having a substantially similar radius as the radius of curvature of curved sheet pile 10. Additional details regarding the method of inserting curved sheet piles 10 and the specific design of curved sheet piles 10 are set forth below.

Figure 5:
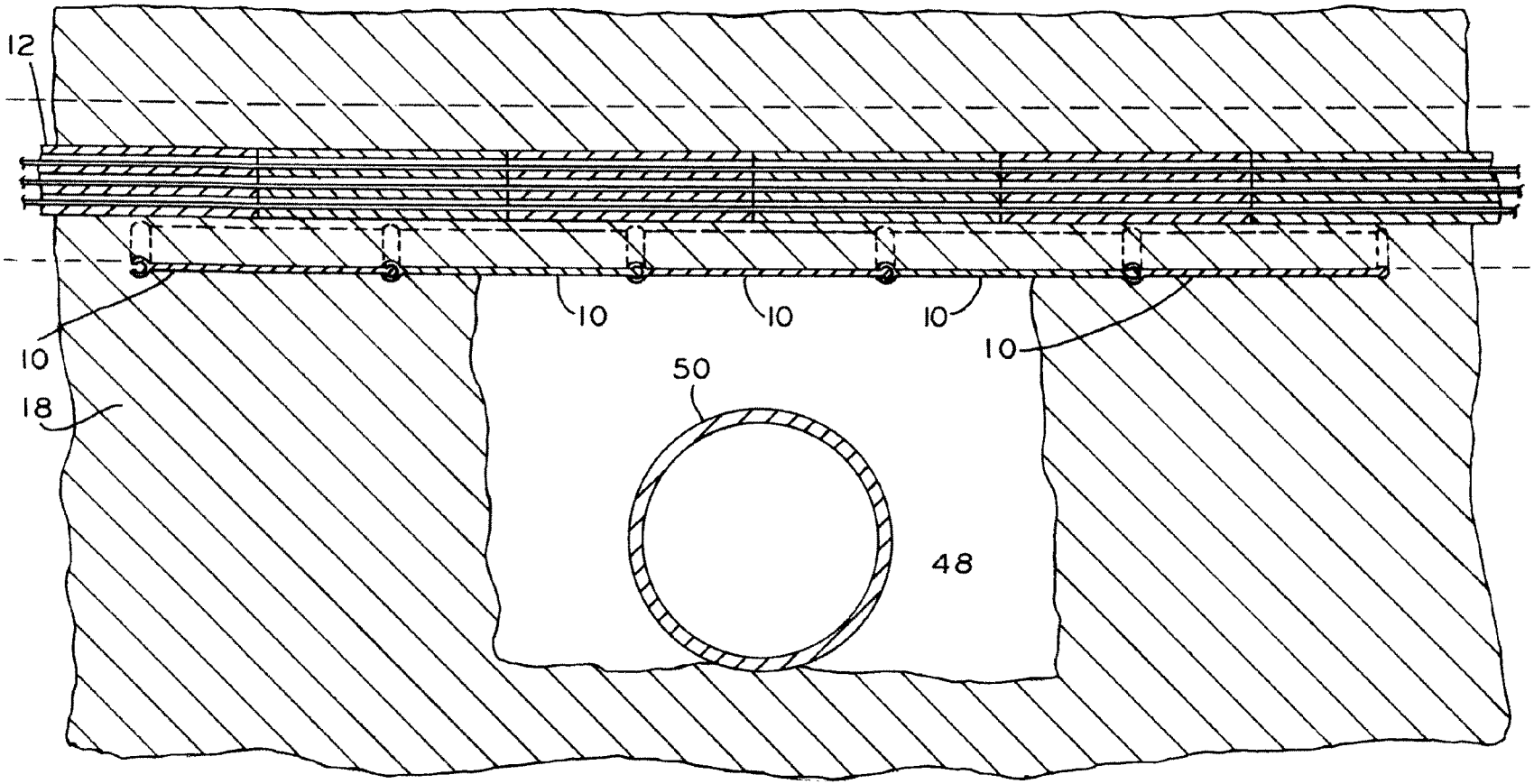
FIG. 5 is a cross-sectional view of curved sheet piles supporting a conduit above an excavated opening having a second conduit extending therethrough.

Once a plurality of sections of curved sheet pile 10 is inserted beneath conduit 12, the individual sections of curved sheet pile 10 may be welded together. Alternatively or additionally, as discussed in detail below, the individual sections of curved sheet pile 10 may be interlocked with one another. Referring to FIG. 5, individual sections of curved sheet pile 10 are shown interlocked with one another and extending across opening 48, which contains conduit 50 that has been positioned beneath conduit 12. By extending across opening 48, a plurality of sections of curved sheet pile 10 cooperate with one another to support conduit 12 and any soil or other subterranean material 18 positioned thereabove.

Advantageously, by utilizing sections of curved sheet pile, such as those described in detail herein, pyramidic loading of subterranean material 18 is provided. Specifically, due to the arcuate shape of the curved sheet pile, the load of subterranean material 18 is directed inwardly toward the center of the radius of curvature of the curved sheet pile. As a result of the pyramidic loading, subterranean material 18 is forced inwardly upon itself, which compacts subterranean material 18 and helps to prevent it from collapsing into trench 16 or otherwise failing to support conduit 12.

Figure 7:
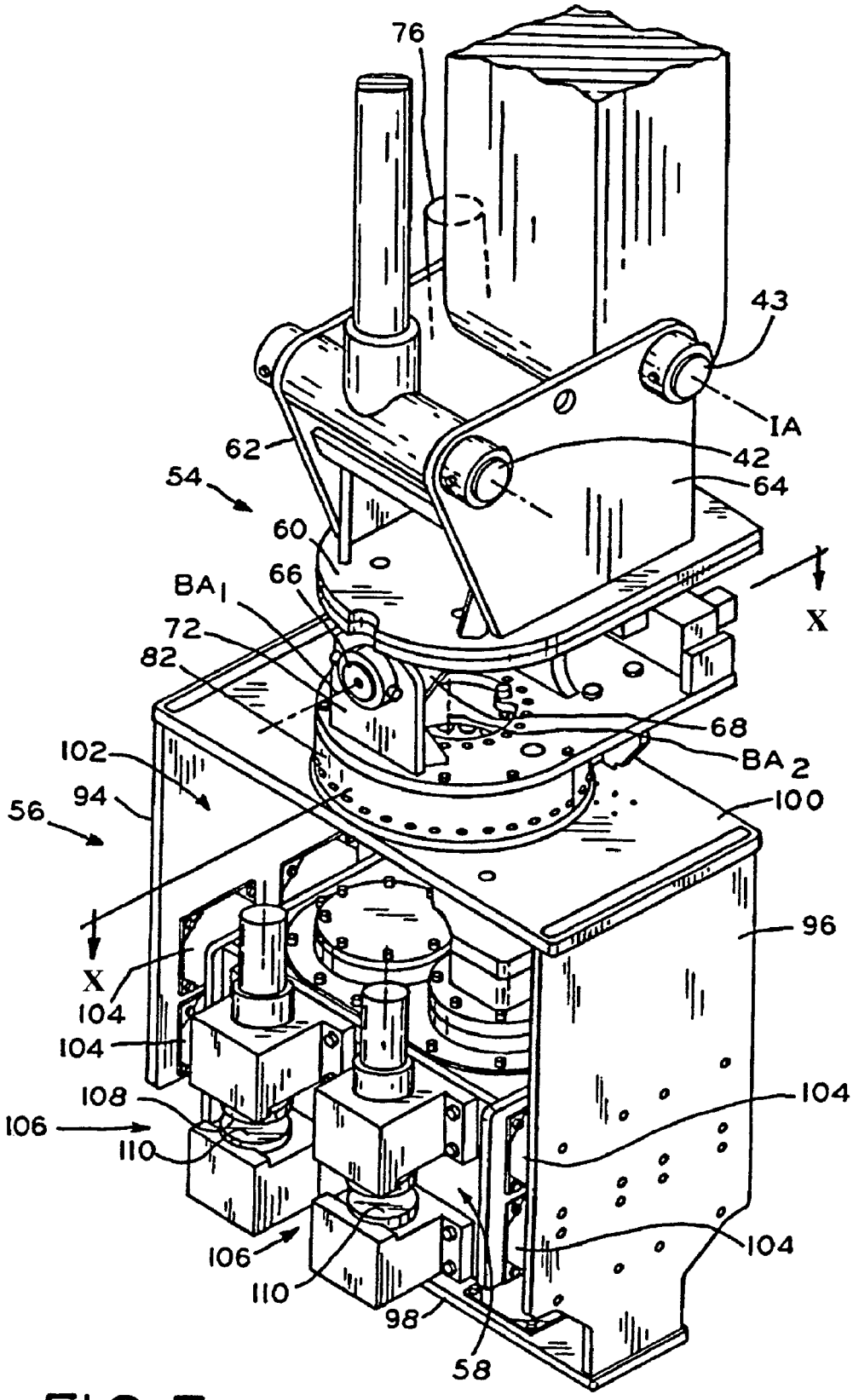
FIG. 7 is a perspective view of the vibratory pile driver and a fragmentary view of the articulated boom of the excavator of FIG. 6.

Referring to FIGS. 6-9, another exemplary embodiment of a pile driver is shown as a vibratory pile driver 52. Referring to FIG. 1, pile driver 52 is shown secured to excavator 20 in a similar manner as described in detail above with respect to pile driver 22 and as described in detail below. Pile driver 22 includes several components that are similar to the Movax Sonic Sidegrip vibratory pile driver commercially available from Hercules Machinery Corporation of Fort Wayne, Ind. In one exemplary embodiment, shown in FIGS. 7-9, pile driver 52 includes head portion 54, body 56, and vibration generator 58. Head portion 54 of pile driver 52 includes support plate 60 having opposing plates 62, 64 that extend upwardly from support plate 60 at a distance spaced apart from one another. Referring to FIG. 7, plates 62, 64 include two pairs of opposing openings that extend through plates 62, 64 that are configured to receive and support pins 42, 43. As indicated above with respect to pile driver 22, pin 42 secures hydraulic cylinder 34 to pile driver 52. Specifically, pin 42 extends through a first opening in plate 62, through an opening formed in second end 40 of cylinder 34, and through an opposing opening in plate 64 to secured cylinder 34 to pile driver 52. A pin or any other known fastener may also be used to secure pin 42 in position and prevent translation of pin 42 relative to plates 62, 64.

Similarly, pin 43 is received through a first opening in plate 62, an opening formed in arm 28 of articulated boom 24, and through an opening in plate 64 to secure arm 28 of articulated boom 24 to pile driver 52. A pin or any other known fastener may also be used to secure pin 43 in position and prevent translation of pin 43 relative to plates 62, 64. With pin 43 secured in this position, pin 43 forms a first fixed pivot element about which pile driver 52 may be rotated relative to articulated boom 24. Specifically, pin 43, in the form of a first fixed pivot element, defines insertion axis IA about which pile driver 52 may be rotated. By actuating hydraulic cylinder 34, a force is applied to pile driver 52 by cylinder 34 via pin 43, which causes pile driver 52 to rotate about insertion axis IA of the first fixed pivot element formed by pin 43. While pin 43 is described and depicted herein as forming the first fixed pivot element about which pile driver 52 is rotatable, any known mechanism for creating an axis of rotation, such as a worm gear mechanism, may be used to form the first fixed pivot element.

Figure 9:
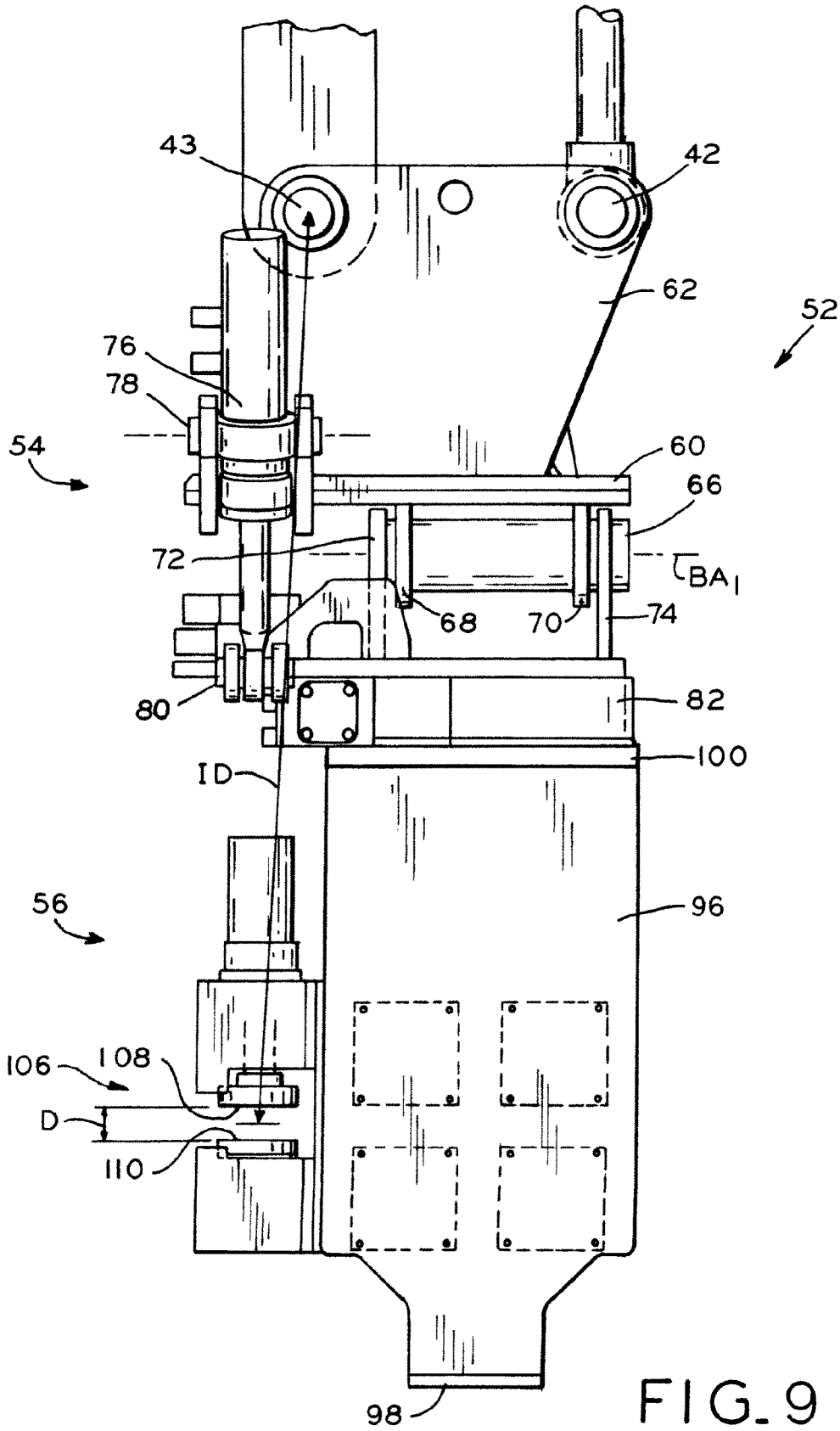
FIG. 9 is a side, elevational view of the vibratory pile driver and articulated boom of FIG. 7.

Referring to FIG. 7, body 56 of pile driver 52 is positioned below head portion 54 and is rotatably secured to head portion 54 by pin 66. As shown in FIG. 9, pin 66 extends through openings in plates 68, 70, which extend downwardly from head portion 54, and plates 72, 74, which extend upwardly from body 36. Pin 66 may be secured in position using pins or other known fasteners that limit translation of pin 66 relative to plates 68, 70, 72, 74. As shown in FIG. 7, with pin 66 in this position, pin 66 forms a second fixed pivot element defining first body axis of rotation $BA_1$ about which body 56 of pile driver 52 may be rotated relative to head portion 54. First body axis of rotation $BA_1$ extends in a direction substantially orthogonal to insertion axis IA. Specifically, hydraulic cylinder 76 is secured to head portion 54 at pivot 78 and is secured to body 56 by pin 80. Thus, when cylinder 76 is actuated, a force is applied to body 56 by cylinder 76 via pin 80. As a result, body 56 is rotated relative to head portion 54 about body axis of rotation $BA_1$ defined by second fixed pivot element formed by pin 66. While pin 66 is described and depicted herein as forming the second fixed pivot element about which body 56 is rotatable relative to head 54, any known mechanism for creating an axis of rotation, such as a worm gear mechanism, may be used to form the second fixed pivot element. In one exemplary embodiment, body 56 is rotatable about first body axis of rotation $BA_1$ through sixty degrees.

Figure 10:
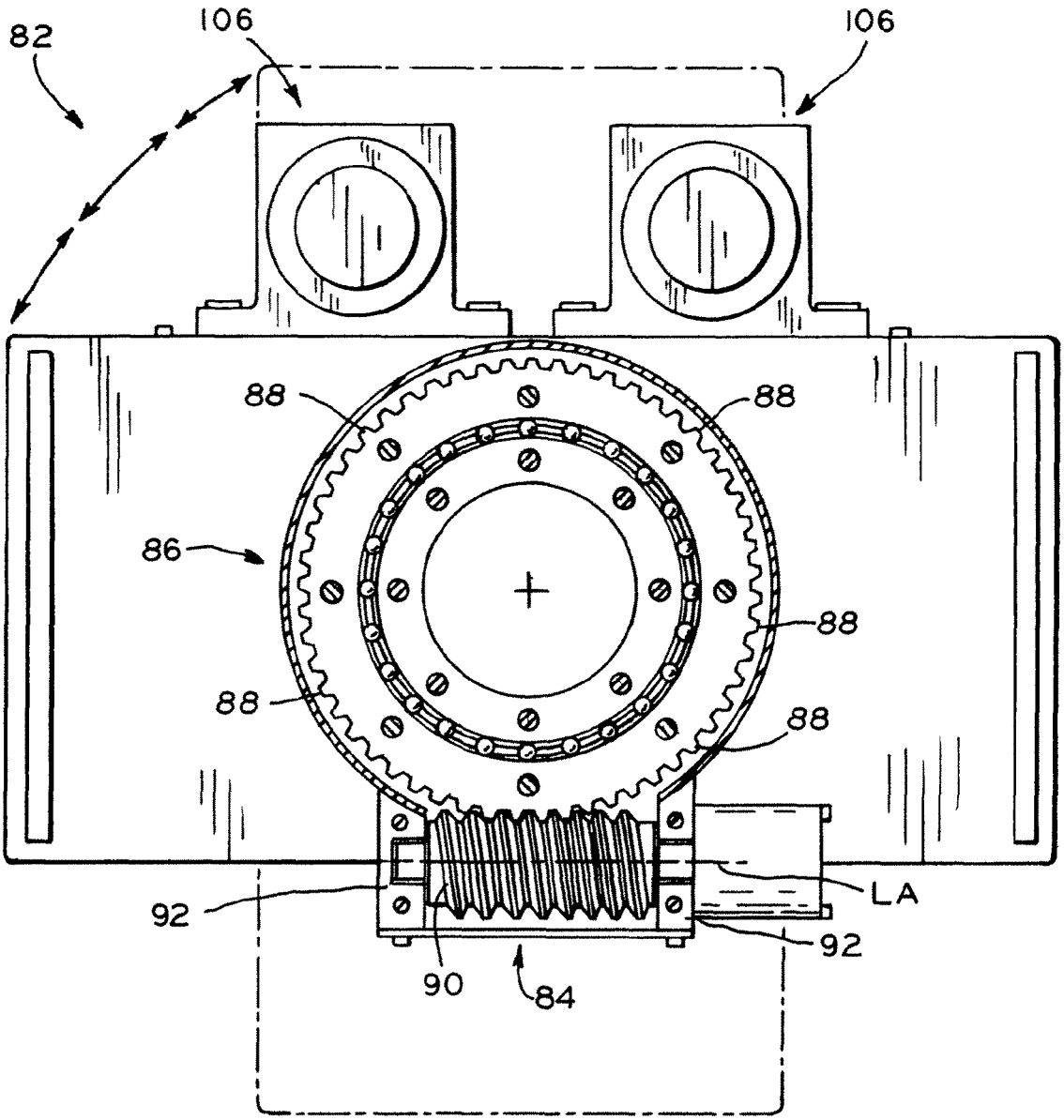
FIG. 10 is a cross-sectional view of the vibratory pile driver of FIG. 7 taken along line 10-10 of FIG. 7.

In addition to rotation about first body axis of rotation $BA_1$, the lower portion of body 56 is rotatable relative to head portion 54 through 360 degrees about second body axis of rotation $BA_2$, shown in FIG. 7. Second body axis of rotation $BA_2$ is substantially orthogonal to both insertion axis IA and first body axis of rotation $BA_1$. Referring to FIG. 10, rotation of the lower portion of body 56 about second body axis of rotation $BA_2$ is achieved by worm gear mechanism 82 which defines a third fixed pivot element. Worm gear mechanism 82 includes worm 84 and worm gear 86. Worm gear 86 includes a plurality of teeth 88 configured to meshingly engage thread 90 extending from worm 84. Worm 84 is translationally fixed by opposing brackets 92, but is free to rotate about longitudinal axis LA. Rotation of worm 84 may be achieved in any known manner, such as by using a hydraulic motor. As worm 84 is driven to rotate about longitudinal axis LA, thread 90 engages teeth 88 and causes corresponding rotation of worm gear 86. As worm gear 86 rotates, the lower portion of body 56 of pile driver 52, which is rotationally fixed thereto, correspondingly rotates. By rotating worm 84, the lower portion of body 56 may be rotated through 360 degrees. In addition, the direction of rotation of the lower portion of body 56 may be reversed by reversing the direction of rotation of worm 84.

Referring again to FIGS. 7-9, the lower portion of body 56 of pile driver 52 includes sides defined by side plates 94, 96, bottom plate 98 forming the foot portion, and top plate 100. Side plates 94, 96 are rigidly fixed to bottom plate 98 and top plate 100, such as by welding, and cooperate with bottom plate 98 and top plate 100 to define opening 102 therebetween. Vibration generator 58 is positioned within opening 102 and secured to side plates 94, 96 and bottom plate 98. Specifically, vibration generator 58 is secured to side plates 94, 96 and bottom plate 98 via dampers 104. Dampers 104 are connected between plates 94, 96, 98 and vibration generator 58 to limit the transmission of vibration generated by vibration generator 58 through pile driver 52 and, correspondingly, through articulated boom 24 of excavator 20.

Vibration generator 58 operates by utilizing a pair of opposing eccentric weights (not shown) configured to rotate in opposing directions. As the eccentric weights are rotated in opposite directions, vibration is transmitted to clamps 106. Additionally, any vibration that may be generated in the direction of side plates 94, 96 of the lower portion of body 54 may be substantially reduced by synchronizing the rotation of the eccentric weights. While vibration generator 58 is described herein as generating vibration utilizing a pair of eccentric weights, any known mechanism for generating vibration may be utilized. Additionally, as indicated above and depending on soil conditions, vibration generator 58 may be absent from hydraulic pile driver 52 and pile driver 52 may utilize hydraulic power generated by excavator 20 or a separate hydraulic pump (not shown) to advance curved sheet pile into subterranean material 18 without the need for vibration generator 58.

Figure 8:
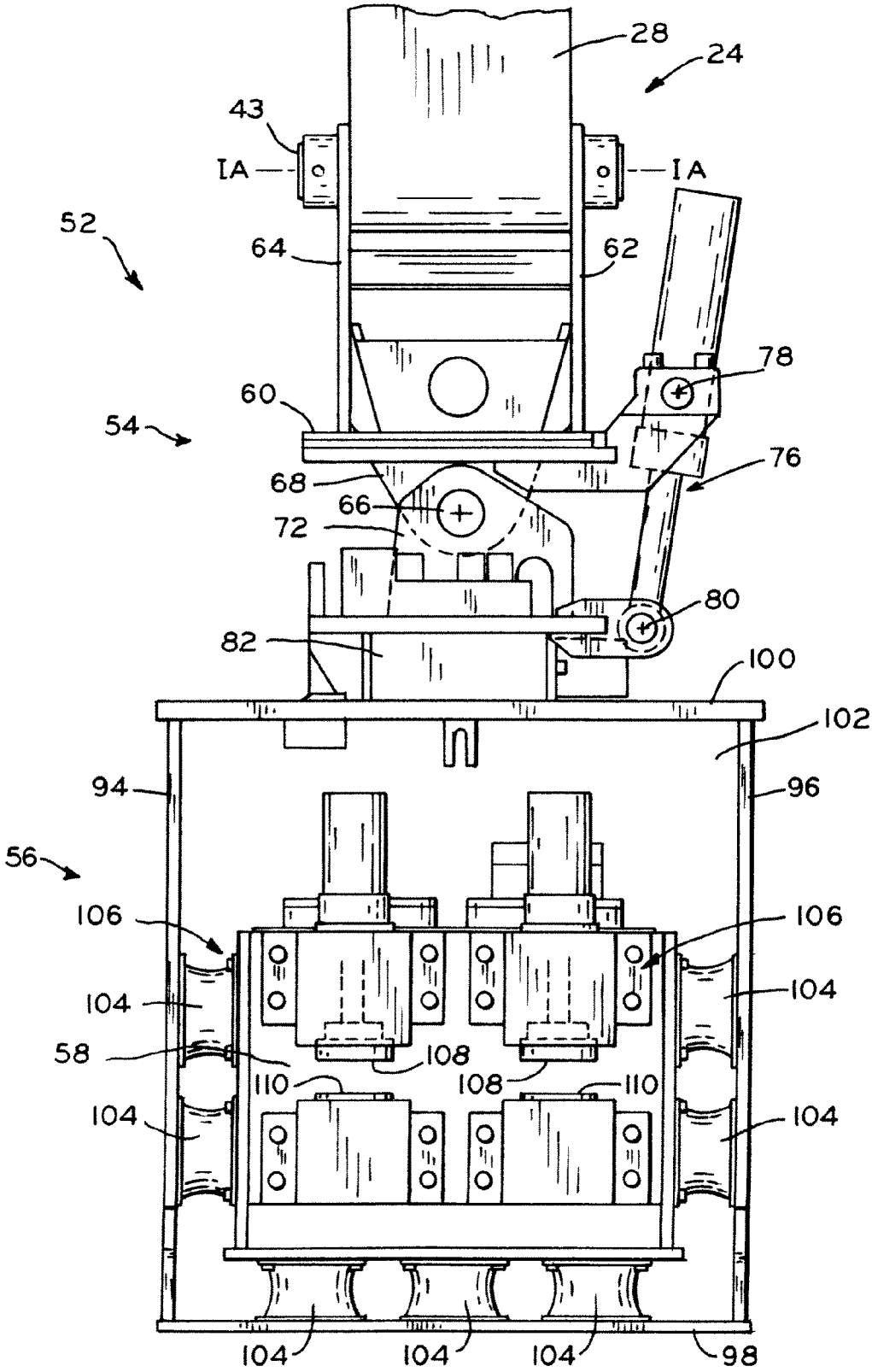
FIG. 8 is a front, elevational view of the vibratory pile driver and articulated boom of FIG. 7 depicting the body of the vibratory pile driver rotated 180 degrees from the position in FIG. 7.
Figure 18:
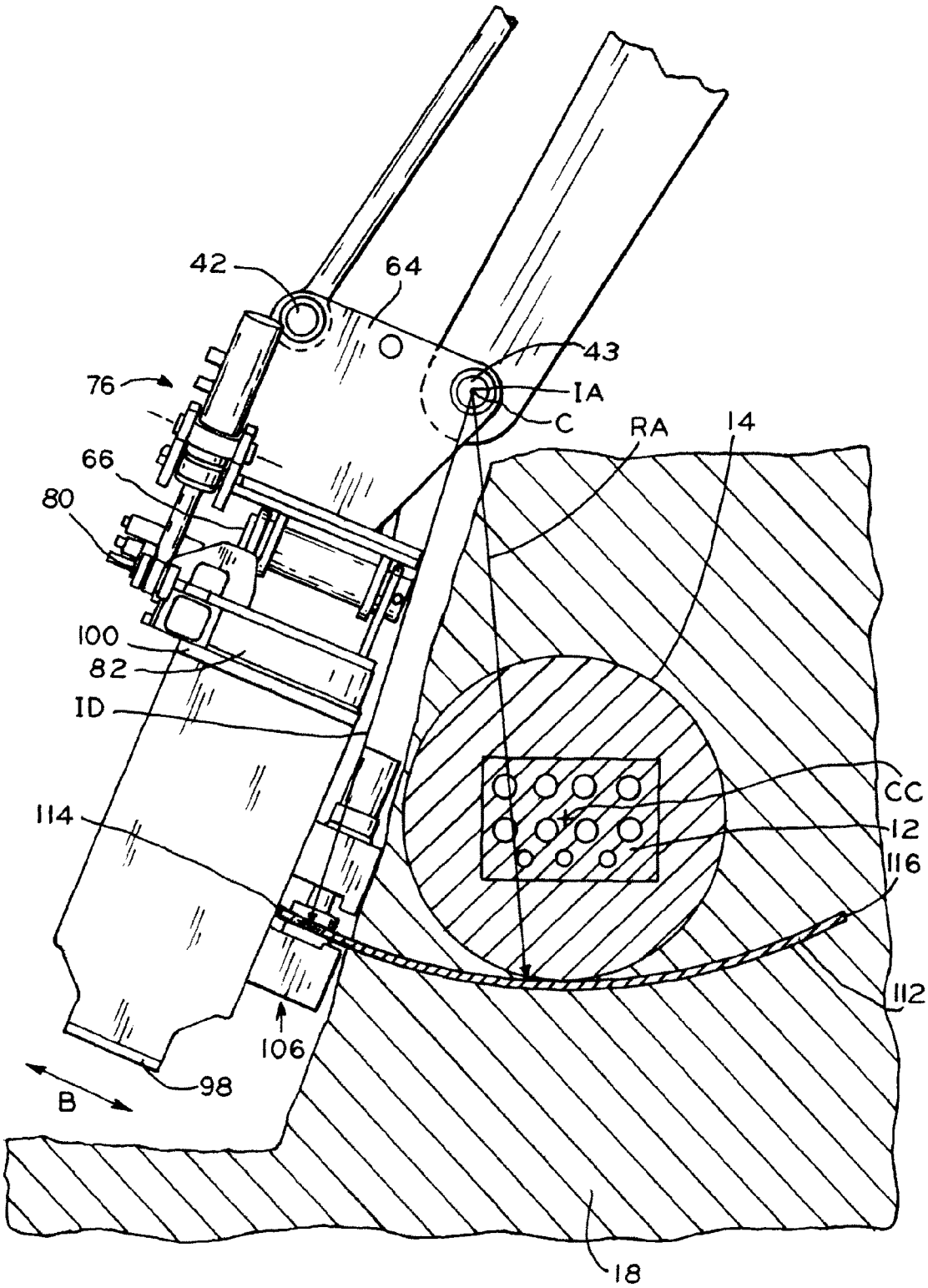
FIG. 18 is a fragmentary, partial cross-sectional view of a section of curved sheet pile being installed beneath a conduit.

As shown in FIGS. 7-9, clamps 106 are secured to vibration generator 58 such that vibration generated by vibration generator 58 is transferred to clamps 106, causing clamps 106 to vibrate in the direction of arrow B of FIG. 18 that is substantially perpendicular to insertion axis IA and second body axis of rotation $BA_2$ and is substantially parallel to first body axis of rotation $BA_1$ (FIGS. 7 and 9). Clamps 106 extend laterally outward beyond one of the sides of body 56 and include opposing clamp surfaces 108, 110. Clamp surfaces 108, 110 are separated by distance D, shown in FIG. 9, when clamps 106 are in the open position of FIG. 8. In one exemplary embodiment, first clamp surface 108 is actuatable to advance first clamp surface 108 in the direction of clamp surface 110. In one exemplary embodiment, clamp surface 108 is formed as a portion of a hydraulic cylinder such that as the hydraulic cylinder is advanced, clamp surface 108 is correspondingly advanced. In another exemplary embodiment, both first clamp surface 108 and second clamp surface 110 are moveable relative to one another.

By advancing clamp surface 108 in the direction of second clamp surface 110, distance D between first and second clamp surfaces 108, 110 is decreased. For example, with clamps 106 in the open position, an edge of curved sheet pile 10 may be advanced through the opening defined between first and second clamp surfaces 108, 110. Then, clamp surface 108 may be advanced in the direction of clamp surface 110. As clamp surface 108 advances toward clamp surface 110, clamp surface 108 will contact curved sheet pile 10. Clamp surface 108 may continue to advance until curved sheet pile 10 is gripped between clamp surfaces 108, 110, such that any movement of pile driver 52 will result in corresponding movement of curved sheet pile 10. Additionally, in one exemplary embodiment, clamp surfaces 108, 110 are substantially planar and extend along a plane that is substantially perpendicular to second body axis of rotation $BA_2$ (FIG. 7). As used herein with respect to clamp surfaces 108, 110, the phrase "substantially planar" is intended to include surfaces that would form substantially planar surfaces, but for the inclusion of undulations, projections, depressions, knurling, or any other surface feature intended to increase friction between clamps surface 108, 110 and a section of curved sheet pile.

Additionally, clamps 106 are positioned such that, with clamp surfaces 108, 110 in a closed position, i.e., in contact with one another, clamp surfaces 108, 110 are spaced an insertion distance ID from insertion axis IA of pile driver 52, as shown in FIG. 9. Referring to FIG. 9, in one exemplary embodiment, clamp surfaces 108, 110 are actuatable to extend along a plane that is substantially perpendicular to a line extending perpendicularly from insertion axis IA to the center of clamp surfaces 108, 110.

In addition to grasping and inserting curved sheet pile 10, pile drivers 22, 52 may be used to insert alternative curved sheet pile designs. Referring to FIGS. 11-14, a preferred embodiment of curved sheet pile 10 is shown as curved sheet pile 112. Curved sheet pile 112 has a radius of curvature RA that extends between rear or gripping edge 114 and front or leading edge 116 of curved sheet pile 112. In exemplary embodiments, radius of curvature RA of curved sheet pile 112 may be as small as 3.0 feet, 4.0 feet, 5.0 feet, 6.0 feet, 8.0 feet, or 10.0 feet and may be as large as 11.0 feet, 12.0 feet, 14.0 feet, 15.0 feet, 16.0 feet, 18 feet, or 20 feet. Side edges 118, 120 of curved sheet pile 112, which have the same radius of curvature RA, extend between gripping edge 114 and leading edge 116 and cooperate with gripping edge 114 and leading edge 116 to define a perimeter of curved sheet pile 112. Openings 122 extend through curved sheet pile 112 between upper surface 124 and lower surface 126 of curved sheet pile 112 to provide openings for securement of curved sheet pile 112 to a beam or other support structure positioned above the excavated opening. In one exemplary embodiment, openings 122 in the form of slots are positioned at the corners of curved sheet pile 112 formed between gripping edge 114, leading edge 116, and side edges 118, 120. Additionally, in one exemplary embodiment, openings 122 are positioned substantially adjacent to gripping edge 114 and leading edge 116. As shown in FIGS. 11-14, openings 122 are formed as slots having arcuate ends 128 that connect opposing straight side walls 130.

Figure 11:
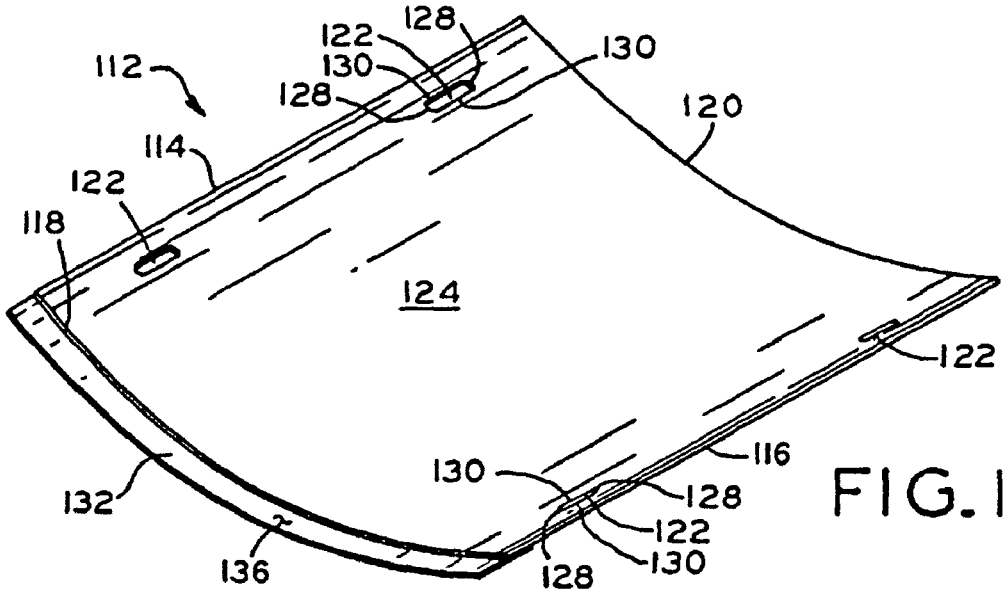
FIG. 11 is a perspective view of a section of curved sheet pile according to an exemplary embodiment.
Figure 12:
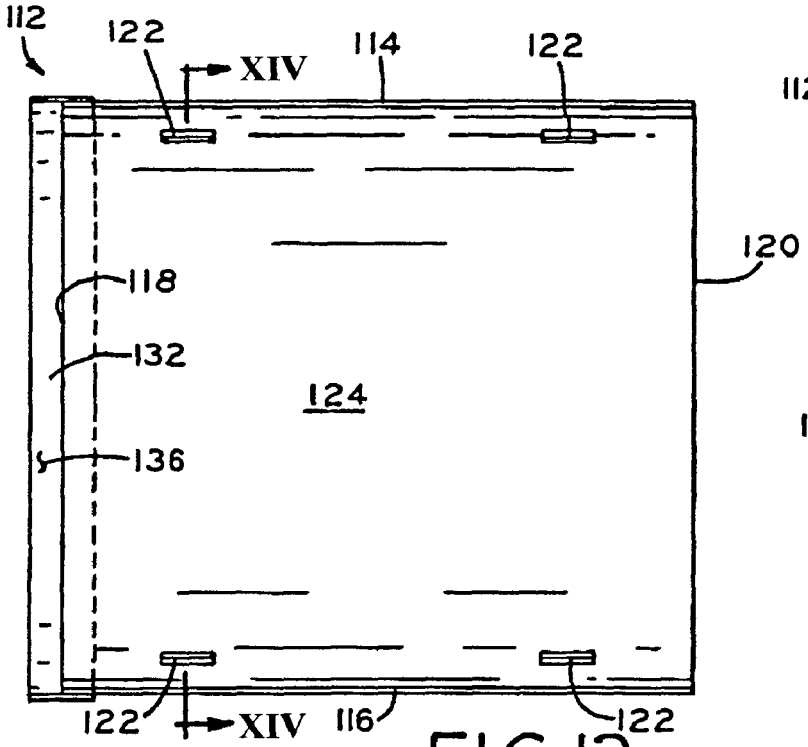
FIG. 12 is a plan view of the curved sheet pile of FIG. 11.
Figure 14:
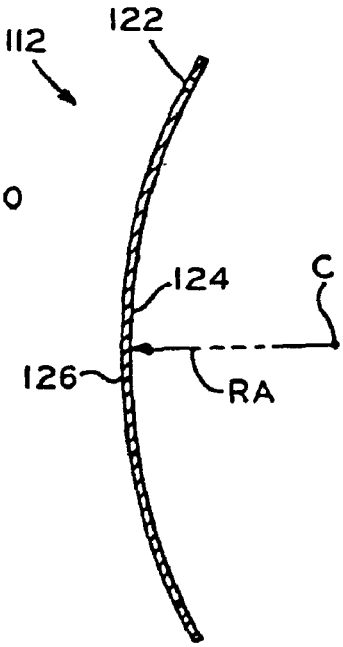
FIG. 14 is a cross-sectional view of the curved sheet pile of FIG. 12 taken along line 14-14 of FIG. 12.
Figure 13:
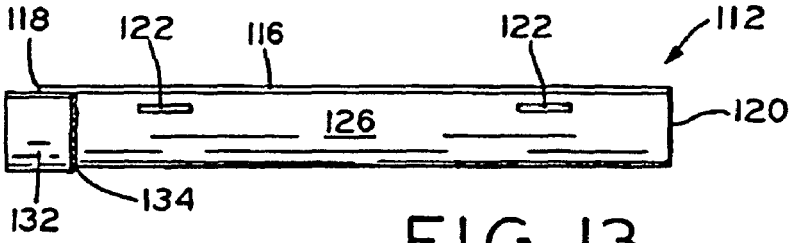
FIG. 13 is a front, elevational view of the curved sheet pile of FIG. 11.
Figure 15:
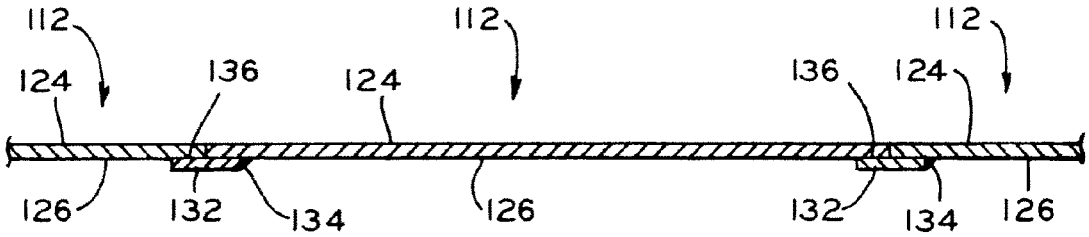
FIG. 15 is a cross-sectional view of a plurality of sections of curved sheet pile according to the embodiment of FIG. 11 positioned adjacent to one another.

Referring to FIGS. 11-13, curved sheet pile 112 also includes flange 132 extending from lower surface 126 thereof. Flange 132 may be secured to lower surface 126 of curved sheet pile 112 in any known manner, such as by welding. For example, flange 132 may be secured to lower surface 126 of curved sheet pile 112 by weld 134. A portion of flange 132 extends from side edge 118 of curved sheet pile 112 and defines support surface 136. Support surface 136 is offset from upper surface 124 of curved sheet pile 112. As shown in FIG. 15, the offset of support surface 136 relative to upper surface 124 of curved sheet pile 112 allows for support surface 136 to be positioned to extend under lower surface 126 of an adjacent section of curved sheet pile 112 to provide for the alignment and support of the adjacent section of curved sheet pile 112, while maintaining upper surfaces 124 of adjacent sections of curved sheet pile 112 substantially evenly aligned with one another between gripping edges 114 and leading edges 116. As a result, the centers C of the radiuses of curvature RA of each of the adjacent section of curved sheet pile 112 are positioned on a single line. Referring to FIG. 15, when positioned in this manner, opposing side edges 118, 120 of adjacent sections of curved sheet pile 112 contact one another and flange 132 acts to interfit the opposing sections of curved sheet pile 112 together. In one exemplary embodiment, the adjacent section of curved sheet pile 112 that is supported atop support surface 136 of flange 132 may be welded to flange 132 or otherwise secured thereto to form a firm connection between adjacent sections of curved sheet pile 112.

By positioning and supporting lower surface 126 of an adjacent section of curved sheet pile 112 atop support surface 136 of flange 132 of a section of curved sheet pile 112, flange 132 acts as a seal to prevent the passage of subterranean material 18 between the adjacent sections of curved sheet pile 112. In addition, flange 132 also provides a guide to facilitate alignment of adjacent sections of curved sheet pile 112 during insertion and also compensates for misalignment of individual sections of curved sheet pile 112.

Figure 16:
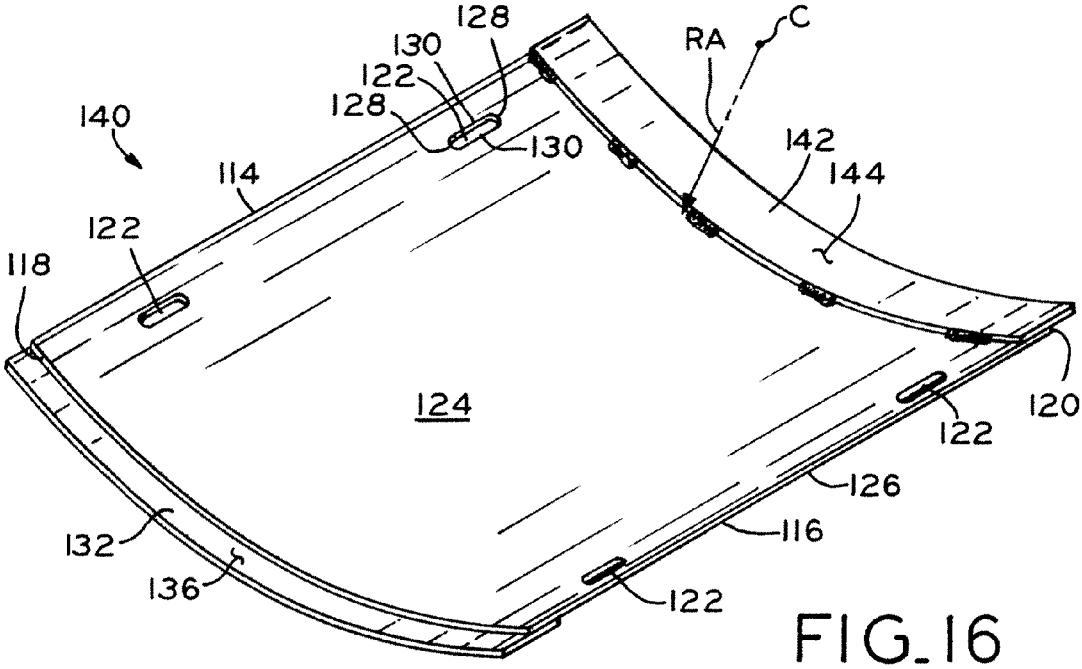
FIG. 16 is a perspective view of a section of curved sheet pile according to another exemplary embodiment.
Figure 17:
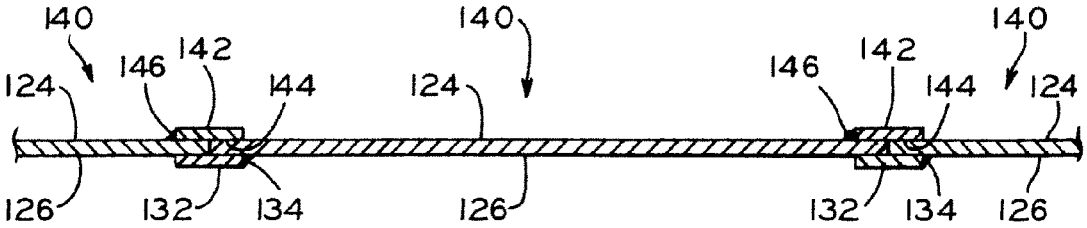
FIG. 17 is a cross-sectional view of a plurality of sections of curved sheet pile according to the embodiment of FIG. 16 positioned adjacent to one another.

Referring to FIGS. 16 and 17, another exemplary embodiment of curved sheet pile 10 is shown as curved sheet pile 140. Curved sheet pile 140 is substantially similar to curved sheet pile 112 and like reference numerals have been used to identify identical or substantially identical parts therebetween. Referring to FIG. 16, in addition to flange 132 extending from lower surface 126 of curved sheet pile 140, curved sheet pile 140 also includes flange 142 extending from upper surface 124 of curved sheet pile 140. Flange 142 extends beyond side edge 120 of curved sheet pile 140 to define support surface 144. Flange 142 may be secured to curved sheet pile 140 in any known manner, such as by welding. Specifically, flange 142 may be secured to curved sheet pile 140 at welds 146.

Referring to FIG. 17, sections of curved sheet pile 140 are shown positioned adjacent to and interfit with one another. Flanges 132, 142 of curved sheet pile 140 cooperate with upper and lower surfaces 124, 126 of the adjacent sections of curved sheet pile, respectively, to interfit adjacent sheets of curved sheet pile to one another. Specifically, referring to FIG. 17, flange 132 of curved sheet pile 140 extends beneath lower surface 126 of an adjacent sheet of curved sheet pile 140. Similarly, flange 142 of the adjacent sheet of curved sheet pile 140 extends across the upper surface 124 of curved sheet pile 140. In this manner, flanges 132, 142 cooperate to interfit adjacent sections of curved sheet pile 140 to one another. Additionally, once in the position shown in FIG. 17, flanges 132, 142 may be secured to the adjacent sections of curved sheet pile, such as by welding.

Advantageously, in addition to the benefits of curved sheet pile 112 identified above, flanges 132, 142, curved sheet pile 140 allows for the creation of an interconnection and interlocking between adjacent sections of curved sheet pile 140 that facilitates the transfer of loading between adjacent sections of curved sheet pile 140. This allows individual sections of curved sheet pile 140 to cooperate with one another and to act as a unitary structure for supporting a conduit. Further, by acting as a unitary structure, sections of curved sheet pile 140 may be substantially simultaneously lifted without the need to lift each individual section of curved sheet pile 140 independently. Flanges 132, 142 also stiffen each individual section of curved sheet pile 140, which makes each individual section of curved sheet pile 140 more resistant to bending during insertion.

Figure 19:
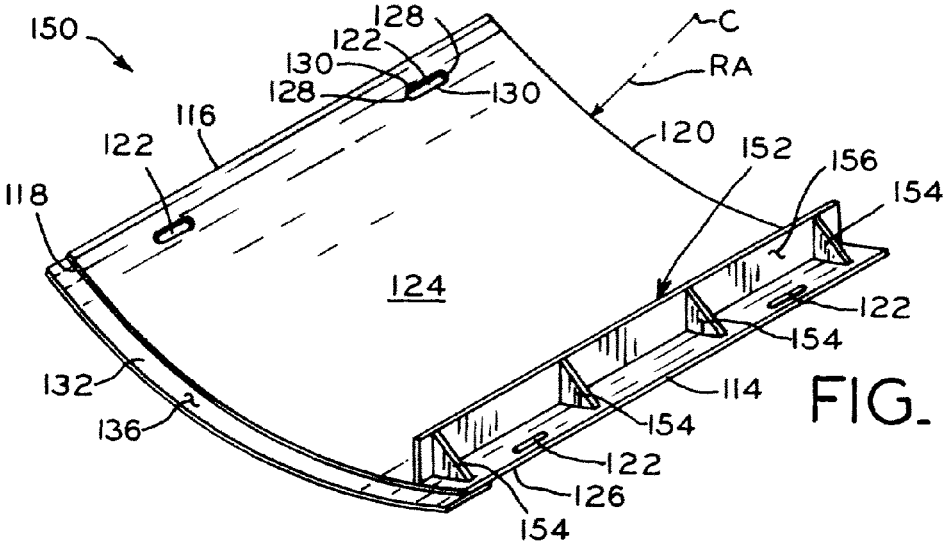
FIG. 19 is a perspective view of a section of curved sheet pile according to another exemplary embodiment.

Referring to FIG. 19, another exemplary embodiment of curved sheet pile 10 is shown as curved sheet pile 150. Curved sheet pile 150 is substantially similar to curved sheet pile 112 and like reference numerals have been used to identify identical or substantially identical parts therebetween. Curved sheet pile 150 includes a projection in the form of radially extending flange 152 extending from upper surface 124 of curved sheet pile 150 toward center C of the radius of curvature RA of curved sheet pile 150. In addition, supports 154 are secured to both rear surface 156 of flange 152 and upper surface 124 of curved sheet pile 150. Flange 152 allows for curved sheet pile 150 to push and/or compact any subterranean material 18 that may fall onto curved sheet pile 150 during insertion back into position beneath a conduit to help prevent the loss of subterranean material 18 from beneath the conduit, as described in detail below. While depicted herein as having a single flange 132, in one exemplary embodiment, curved sheet pile 150 also includes flange 142 as described in detail herein with specific reference to curved sheet pile 140

Figure 20:
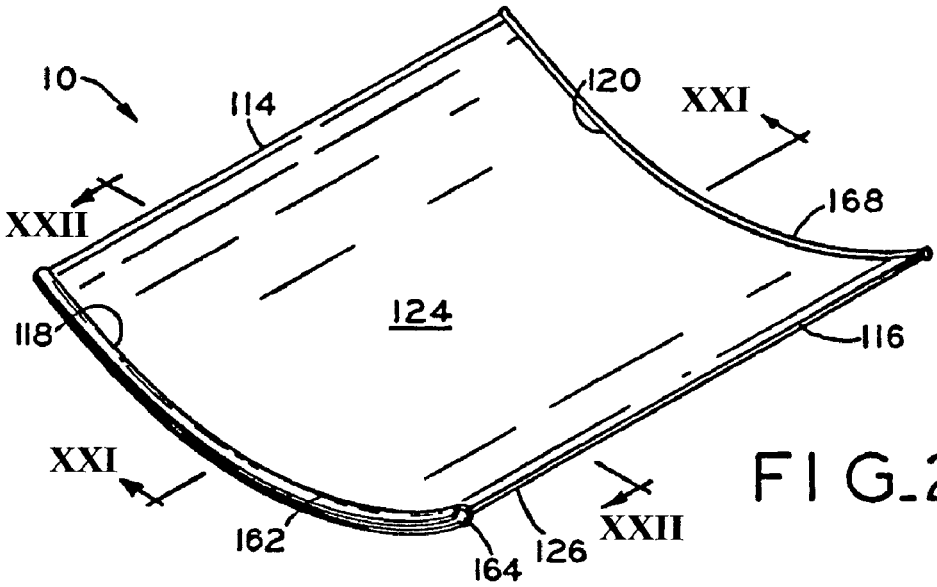
FIG. 20 is a perspective view of a sheet of curved sheet pile according to an exemplary embodiment.
Figure 21:
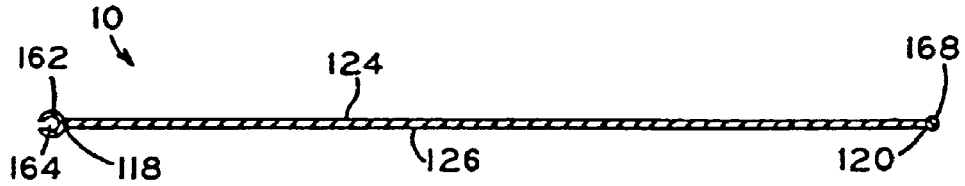
FIG. 21 is a cross-sectional view of the curved sheet pile of FIG. 20 taken along line 21-21 of FIG. 20.
Figure 22:
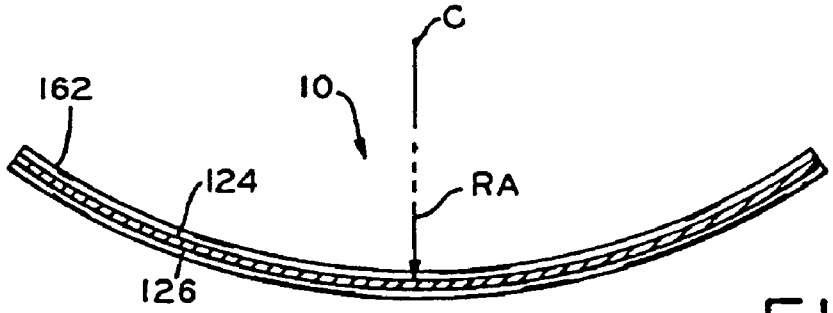
FIG. 22 is a cross-sectional view of the curved sheet pile of FIG. 20 taken along line 22-22 of FIG. 20.
Figure 23:
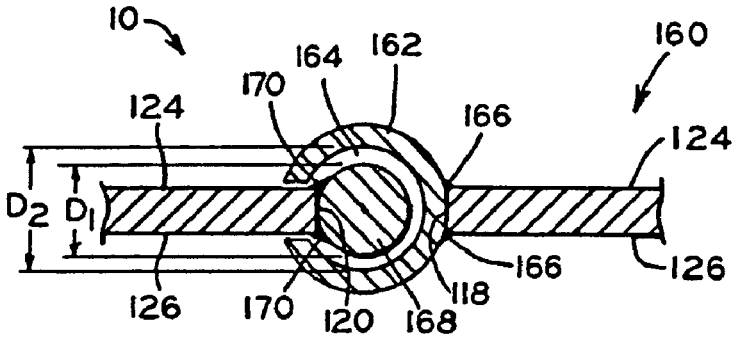
FIG. 23 is an enlarged, fragmentary, cross-sectional view of adjacent sections of the curved sheet pile of FIG. 20 interlocked to one another.
Figure 24:
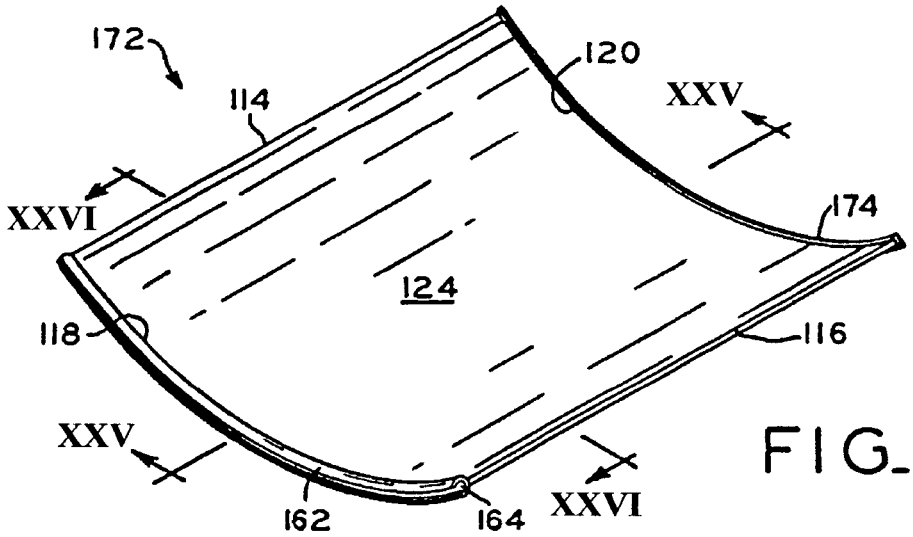
FIG. 24 is a perspective view of a section of curved sheet pile according to another exemplary embodiment.
Figure 25:
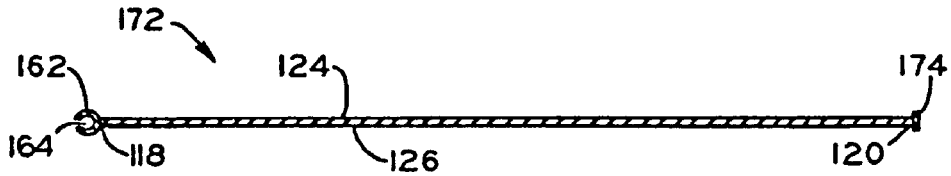
FIG. 25 is a cross-sectional view of the curved sheet pile of FIG. 24 taken along line 25-25 of FIG. 24.
Figure 26:
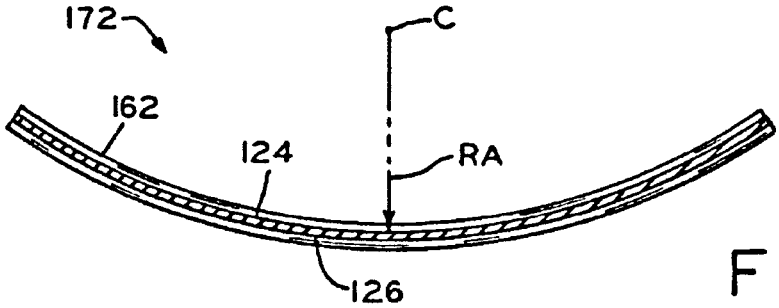
FIG. 26 is a cross-sectional view of the curved sheet pile of FIG. 24 taken along line 26-26 of FIG. 24.
Figure 27:
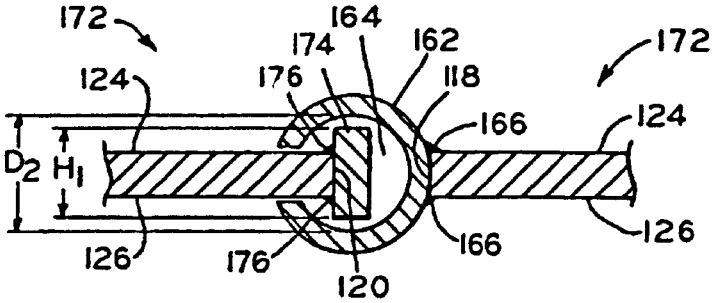
FIG. 27 is an enlarged, fragmentary, cross-sectional view of adjacent sections of the curved sheet pile of FIG. 24 interlocked together.

Referring to FIGS. 20-23, the design and installation of an alternative and less preferred from of curved sheet pile 10 will now be discussed in detail. Curved sheet pile 10 is substantially similar to curved sheet pile 112 and like reference numerals have been used to identify identical or substantially identical parts therebetween. While depicted herein as lacking openings 122, in one exemplary embodiment, curved sheet pile 10 includes openings 122 to allow curved sheet pile 10 to be used with support systems 180, 200, described in detail below. Curved sheet pile 10 is designed to interconnect with an adjacent section of curved sheet pile 10. Referring to FIG. 20, instead of using flanges 132, 142, curved sheet pile 10 includes a length of hollow, curved rod 162 defining C-shaped channel 164 that is connected to a first end of each individual sheet of curved pile 10. As shown in FIG. 23, in one exemplary embodiment, curved rod 162 is welded to curved pile 10 at welds 166. Secured to the opposing end of each individual sheet of curved pile 10 is solid curved rod 168. In one exemplary embodiment, as shown in FIG. 23, solid curved rod 168 is secured to pile 10 by welds 170.

By utilizing curved sheet pile 10, as shown in FIGS. 20-23, opposing ends of individual sections of curved sheet pile 10 may be interconnected by inserting solid curved rod 168 within hollow curved rod 162, as shown in FIG. 20. Specifically, a first section of curved sheet pile 10 is positioned beneath conduit 12 in the manner described in detail herein. Once a first section of curved sheet pile 10 is in the desired position, a second section of curved sheet pile 10 is aligned with solid curved rod 168 of the second section of curved sheet pile 10 positioned adjacent to C-shaped channel 164 of the first section of curved sheet pile 10. By advancing the second section of curved sheet pile 10 along an arc having a radius of curvature substantially similar to the radius of curvature RA of curved sheet pile 10, solid curved rod 168 of the second section of curved sheet pile 10 is advanced through C-shaped channel 164 of curved rod 162 of the first section of curved sheet pile 10. This process is then repeated for additional sections of curved sheet pile 10 until an interlocked support structure, such as that shown in FIG. 5, is created by the interconnected sections of curved sheet pile 10.

By interconnecting individual sections of curved sheet pile 10 with one another, the need to weld adjacent sections of curved sheet pile 10 together may be substantially lessened and/or eliminated. However, individual sections of curved sheet pile may still be welded together to provide additional strength and support to the entire structure. Additionally, while the description of the interconnection of curved sheet pile 10 is described as advancing solid curved rod 168 through C-shaped channel 164, the same interconnected can be accomplished by positioning C-shaped channel 164 adjacent curved rod 168 and advancing C-shaped channel 164 defined by curved rod 162 along solid curved rod 168.

Referring to FIG. 23, solid curved rod 168 has an outer diameter $D_1$ that is less than inner diameter $D_2$ of hollow curved rod 162 that defines the C-shaped channel 164. In one exemplary embodiment, outer diameter $D_1$ is substantially less than inner diameter $D_2$ to prevent binding of the individual sections of curved pile 10 as they are being interlocked with one another. For example, in one exemplary embodiment, outer diameter $D_1$ of solid curved rod 168 is 1 inch, while inner diameter $D_2$ of hollow curved rod 162 is ½ inch.

Referring to FIGS. 24-27, another exemplary embodiment of curved sheet pile 10 is depicted as curved sheet pile 172. Curved sheet pile 172 has several characteristics that are substantially similar or identical to corresponding characteristics of curved sheet pile 10 and like reference numerals have been used to identify substantially similar or identical parts therebetween. As shown in FIGS. 24-27, curved sheet pile 172 includes hollow curved rod 162 defining C-shaped channel 164. However, at the opposing end of curved sheet pile 172, curved bar 174 having a rectangular cross-section is secured to curved sheet pile 172. In one exemplary embodiment, shown in FIG. 27, curved bar 174 is secured to curved sheet pile 172 at welds 176.

Curved bar 174 interacts in a substantially similar manner with hollow curved rod 162 as solid curved rod 168 of curved sheet pile 10. For example, curved bar 174 has a height $H_1$ that is substantially less than inner diameter $D_2$ of hollow curved rod 162 that defines C-shaped channel 164. Thus, in a substantially similar manner as described in detail above with specific reference to curved sheet pile 10, individual sections of curved sheet pile 172 may be interconnected to one another. Specifically, to interconnect adjacent sections of curved sheet pile 172, a first section of curved sheet pile 172 is positioned beneath conduit 12 in the manner described in detail herein. Once a first section of curved sheet pile 172 is in position, a second section of curved sheet pile 172 is aligned with solid curved bar 174 of the second section of curved sheet pile 172 positioned adjacent C-shaped channel 164 of the first section of curved sheet pile 172.

By advancing the second section of curved sheet pile 172 along an arc having a radius of curvature substantially similar to the radius of curvature of curved sheet pile 172, curved bar 174 of the second section of curved sheet pile 172 is advanced through C-shaped channel 164 of curved rod 162 of the first section of curved sheet pile 172. Once the second sheet of curved sheet pile 172 is in the desired position, the process can be repeated for additional sections of curved sheet pile 172 until a sufficient support structure is created by the interconnected sections of curved sheet pile 172. Additionally, while the description of the interconnecting of curved sheet pile 172 is described as advancing curved bar 174 through C-shaped channel 164, the same interconnection can be accomplished by positioning C-shaped channel 154 adjacent curved bar 174 and advancing C-shaped channel 164 defined by curved rod 162 along curved bar 174.

As indicated above, pile driver 52 allows for curved sheet pile 10, 112, 140, 150, 172 to be inserted beneath a conduit by pivoting pile driver 52 about insertion axis IA (FIG. 7), without the need to otherwise move or manipulate pile driver 52 and/or excavator 20 in any other manner. Referring to FIG. 17, in order to insert a section of curved sheet pile, such as curved sheet pile 112, clamps 106 are positioned to grasp gripping edge 114 of curved sheet pile 112. While described and depicted with specific reference to curved sheet pile 112, pile driver 52 may be used with any other type of curved sheet pile, such as curved sheet pile 10, 140, 150, 172. By positioning gripping edge 114 of curved sheet pile 112 such that it extends beyond first and second clamp surfaces 108, 110 in a direction toward pile driver 52, one of first and second clamp surfaces 108, 110 may be advanced toward the other of clamp surfaces 108, 110 to capture curved sheet pile 112 therebetween. In one exemplary embodiment, as indicated above, clamps 106 are hydraulically actuated to clamp curved sheet pile 112 between first and second clamp surfaces 108, 110.

Referring to FIG. 18, with curved sheet pile 112 secured by clamps 106, curved sheet pile 112 may be positioned with leading edge 116 of curved sheet pile 112 positioned adjacent to and below conduit 12. Preferably, insertion axis IA, which is defined by pin 43, is also positioned directly vertically above center CC of conduit 12. With curved sheet pile 112 positioned within the excavated opening and before leading edge 116 of curved sheet pile 112 is advanced into subterranean material 18, the position of pile driver 52 and/or excavator 20 may be locked, such that movement of pile driver 52 and/or excavator 20 is substantially limited or entirely prevented. Hydraulic cylinder 34 of excavator 20 may then be actuated to extend hydraulic cylinder 34 and rotate pile driver 52 and, correspondingly, curved sheet pile 112.

Specifically, as hydraulic cylinder 34 is extended, pile driver 52 is rotated about insertion axis IA. Advantageously, by selecting a section of curved sheet pile 112 having radius of curvature RA that is substantially identical to insertion distance ID of pile driver 52 and positioning clamps 106 such that the center of the radius of curvature of curved sheet pile 112 lies substantially on insertion axis IA, curved sheet pile may be inserted along an arc having a radius of curvature that is substantially identical to radius of curvature RA of curved sheet pile 112. By positioning clamps 106 such that insertion distance ID is substantially equal to radius of curvature RA of curved sheet pile 112 and center C of the radius of curvature of curved sheet pile 112 lies substantially on insertion axis IA, pile driver 52 may be actuated about insertion axis IA to allow pile driver 52 to position curved sheet pile 112 beneath a conduit without the need for any additional movement of pile driver 52 and/or articulated boom 24 of excavator 20. Stated another way, with insertion distance ID being substantially identical to radius of curvature RA of curved sheet pile 112, a point that lies substantially on insertion axis IA defines center C of radius of curvature RA of curved sheet pile 112, as shown in FIG. 18. While described herein as having insertion distance ID being substantially identical to radius of curvature RA of curved sheet pile 112, insertion distance ID may be a few percent, e.g., one percent, two percent, or three percent, less than or greater than radius of curvature RA of curved sheet pile 112, while still operating in a similar manner as described in detail herein and also still providing the benefits identified herein.

Advantageously, by utilizing an insertion distance ID that is substantially identical to radius of curvature RA of curve sheet pile 112 and positioning center C of radius of curvature RA on insertion axis IA, pile driver 52 may be actuated to rotate about a single, stationary axis, i.e., insertion axis IA, to insert curved sheet pile 112 into subterranean material 18 and maintain the advancement of curved sheet pile 112 along an arc having the same curvature as curved sheet pile 112. This eliminates the need for the operator of excavator 20 to simultaneously manipulate the position of articulated boom 24 while pile driver 52 is being rotated in order to adjust the position of insertion axis IA to facilitate the insertion of curved sheet pile 112 along an arcuate path having the same curvature as curved sheet pile 112. Stated another way, the present invention eliminates the need for the operator of the excavator to manipulate articulated boom 24 and/or pile driver 52 to attempt to maintain center C of radius of curvature RA of curved sheet pile 112 at a point that lies substantially on insertion axis IA of pile driver 52.

Figure 28:
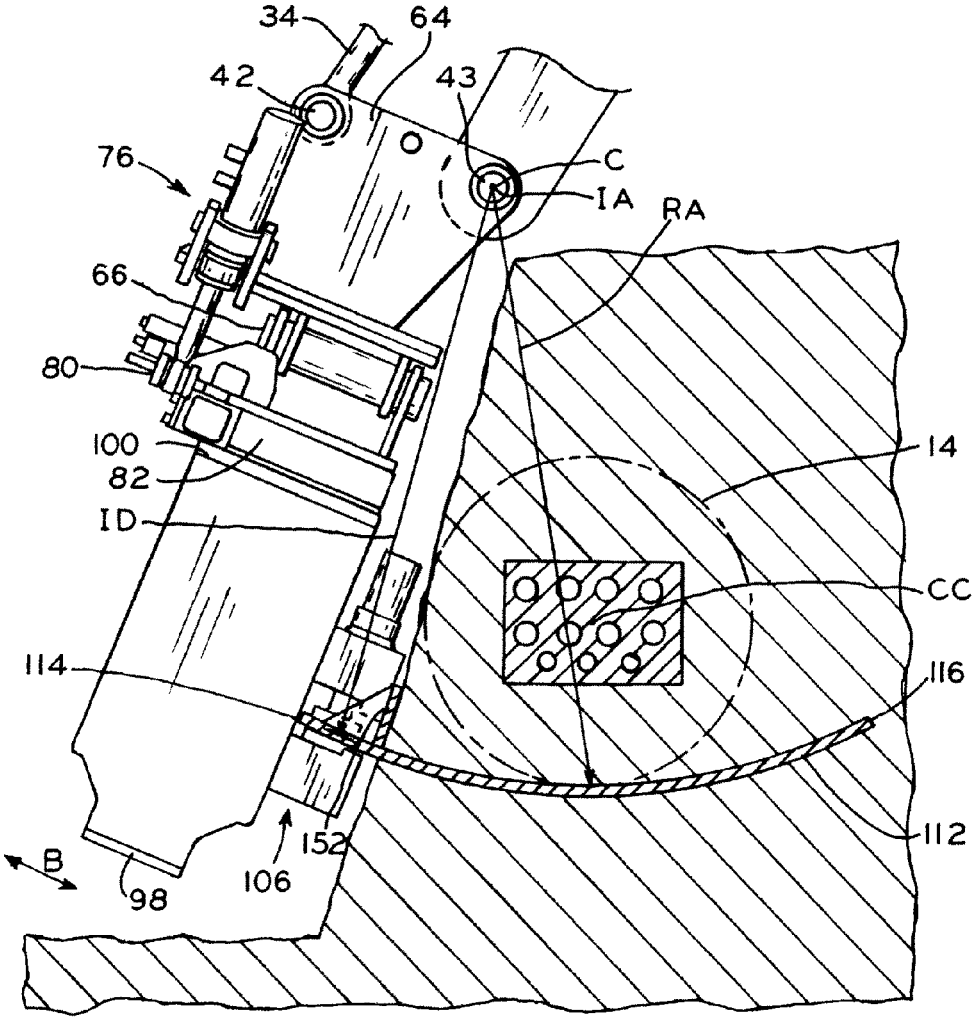
FIG. 28 is a fragmentary, partial cross-sectional view of the section of curved sheet pile of FIG. 19 being installed beneath a conduit.

Referring to FIG. 28, pile driver 52 is shown inserting curved sheet pile 150 into subterranean material 18. As indicated above, during insertion of curved sheet pile 150 into subterranean material 18, any subterranean material, such as soil and/or rocks, that may fall onto upper surface 124 of curved sheet pile 150 may be compacted into subterranean material 18 by flange 152. Specifically, as flange 152 arrives at the position shown in FIG. 28, any subterranean material 18 that may have fallen onto upper surface 124 of curved sheet pile 150 is compacted by flange 152 into subterranean material 18 that is providing support for conduit 12. In this manner, any subterranean material 18 that may come loose from beneath conduit 12 during insertion of curved sheet pile 150 is compacted beneath conduit 12 to maintain the support of conduit 12 provided by subterranean material 18.

While the insertion of cured sheet pile 10, 112, 140, 150, 172 is primarily described in detail herein with specific reference to pile driver 52, pile driver 22 may also be used to insert curved sheet pile 10, 112, 140, 150, 172 in a substantially similar manner as described in detail herein with respect to pile driver 52. However, in order to insert curved sheet pile 10, 112, 140, 150, 172 along an arc having the same radius as radius of curvature RA of curved sheet pile 10, 112, 140, 150, pile driver 22 must be rotated about pin 43 and the position of pile driver 22 must also be adjusted by excavator 20 during the insertion of curved sheet pile 10, 112, 140, 150, 172.

Figure 29:
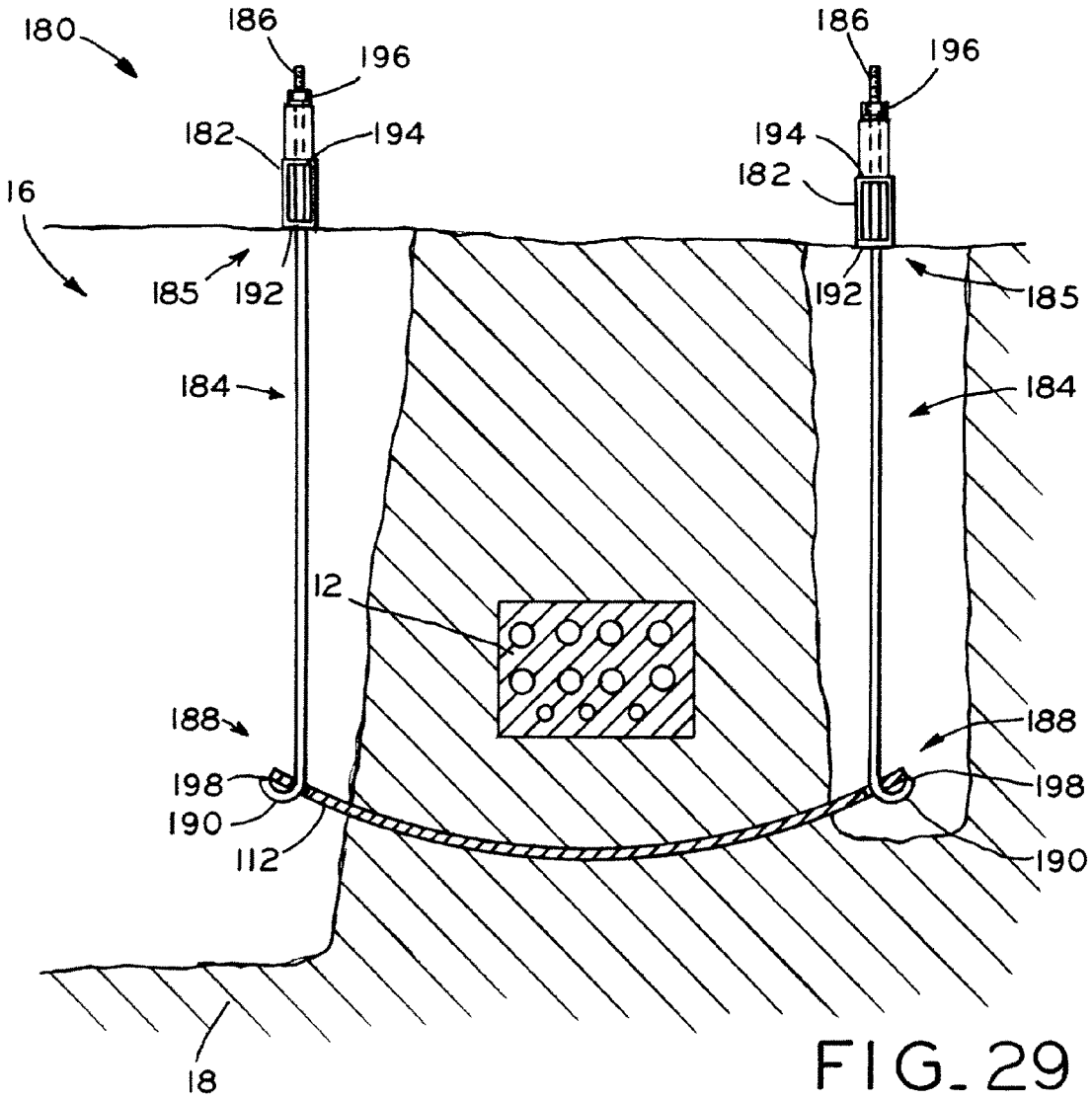
FIG. 29 is a cross-sectional view of a section of curved sheet pile positioned beneath a conduit and secured in position by a support system.
Figure 30:
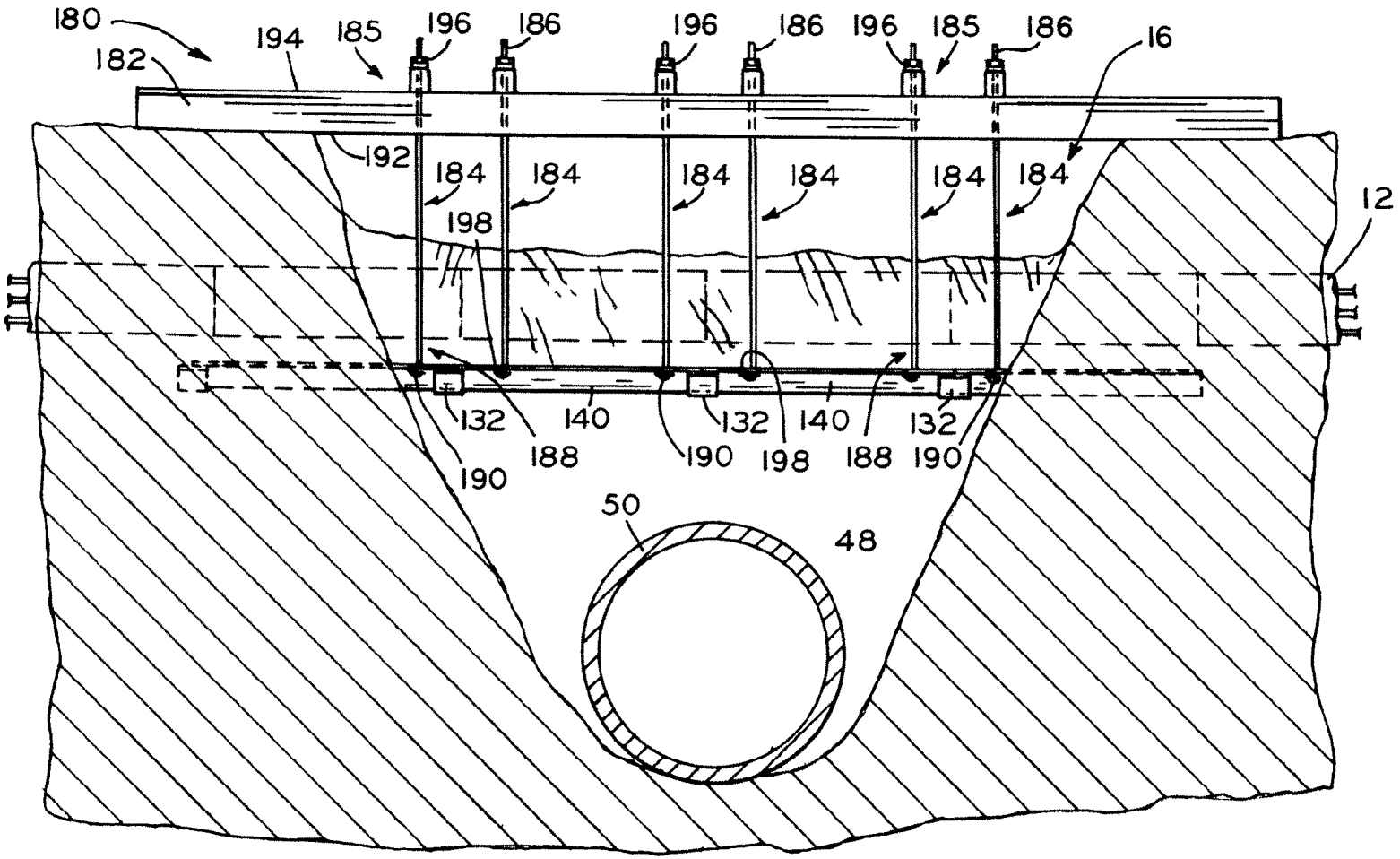
FIG. 30 is a partial cross-sectional view of a plurality of sections of curved sheet pile positioned beneath a conduit and secured in position by the support system of FIG. 29.

Referring to FIGS. 29 and 30, support structure 180 for supporting sections of curved sheet pile 10, 112, 140, 150, 172 after sections of curved sheet pile 10, 112, 140, 150, 172 have been inserted within subterranean material 18 is shown. In the preferred embodiment, curved sheet pile 140 is used to provide for the interconnection and interlocking of adjacent sections of curved sheet pile 140. Accordingly, curved sheet pile 140 is shown in FIGS. 29 and 30. However, only lower flanges 132 have been shown for clarity. Referring to FIGS. 29 and 30, beams 182 are positioned to extend across trench 16 formed in subterranean material 18. In this manner, the opposing ends of beams 182 that contact the surface on opposing sides of trench 16 provide a base of support for sections of curved sheet pile 10, 112, 140, 150, 172. Specifically, in order to connect individual sections of curved sheet pile 10, 112, 140, 150, 172 to beams 182, elongate suspension members, which may be in the form of metal rods 184, are used. Rods 184 have beam connection ends 185 and opposing pile connection ends 188. In one exemplary embodiment, beam connections ends 185 are formed as threaded ends 186 and pile connection ends 188 of rods 184 are formed as J-hooks 190. In order to secure rods 184 to sections of curved sheet pile 10, 112, 140, 150, 172, rods 184 are inserted through openings 122 in curved sheet pile 10, 112, 140, 150, 172, by longitudinally aligning J-hooks 190 with planar side walls 130 of openings 122. J-hooks 190 are then advanced through openings 122 and rotated 90 degrees to capture a portion of curved sheet pile 10, 112, 140, 150, 172 on J-hooks 190 and prevent J-hooks 190 from advancing back out of openings 122.

In order to secure rods 184 to beams 182, threaded ends 186 of rods 184 are advanced through openings formed in beams 182. Specifically, threaded ends 186 of rods 184 are advanced through beams 182 from lower, ground contacting surfaces 192 of beams 182 until at least a portion of threaded ends 186 of rods 184 extend from upper surfaces 194 of beams 182. Threaded nuts 196 are then threadingly engaged with threaded ends 186 of rods 184 and advanced therealong. Specifically, nuts 196 are advanced in the direction of upper surfaces 194 of beams 182 until nuts 196 firmly engage upper surfaces 194 of beams 182. For example, nuts 196 may be advanced until ends 198 of J-hooks 190 are in contact with lower surfaces 126 of sections of curved sheet pile 10, 112, 140, 150, 172. Once in this position, curved sheet pile 10, 112, 140, 150, 172 is sufficiently supported by beams 182 and rods 184. If desired, nuts 196 may continue to be advanced. As nuts 196 are advanced, rods 184 are corresponding advanced in the direction of beams 182. This causes curved sheet pile 10, 112, 140, 150, 172, which is now secured to rods 184, to be lifted in the direction of beams 182 to provide additional support to conduit 12. With respect to embodiments of the curved sheet pile, such as curved sheet pile 140, that include flanges 132, as the curved sheet pile is lifted, flanges 132 engage lower surfaces 126 of the adjacent sections of curved sheet pile to allow for the cooperative lifting of all of the sections of curved sheet pile.

The process for the securement of curved sheet pile 10, 112, 140, 150, 172 may be repeated as necessary to further secure individual sections of curved sheet pile 10, 112, 140, 150, 172 to support structure 180 or to secure additional sections of curved sheet pile 10, 112, 140, 150, 172 to support structure 180. Specifically, in one exemplary embodiment, curved sheet pile 10, 112, 140, 150, 172 is secured at each of openings 122 by rods 184 to beams 182. Alternatively, rods 184 may be secured to a support extending from beams 182 or to a connection point (not shown) formed on beams 182.

Figures 31, 32, 33:
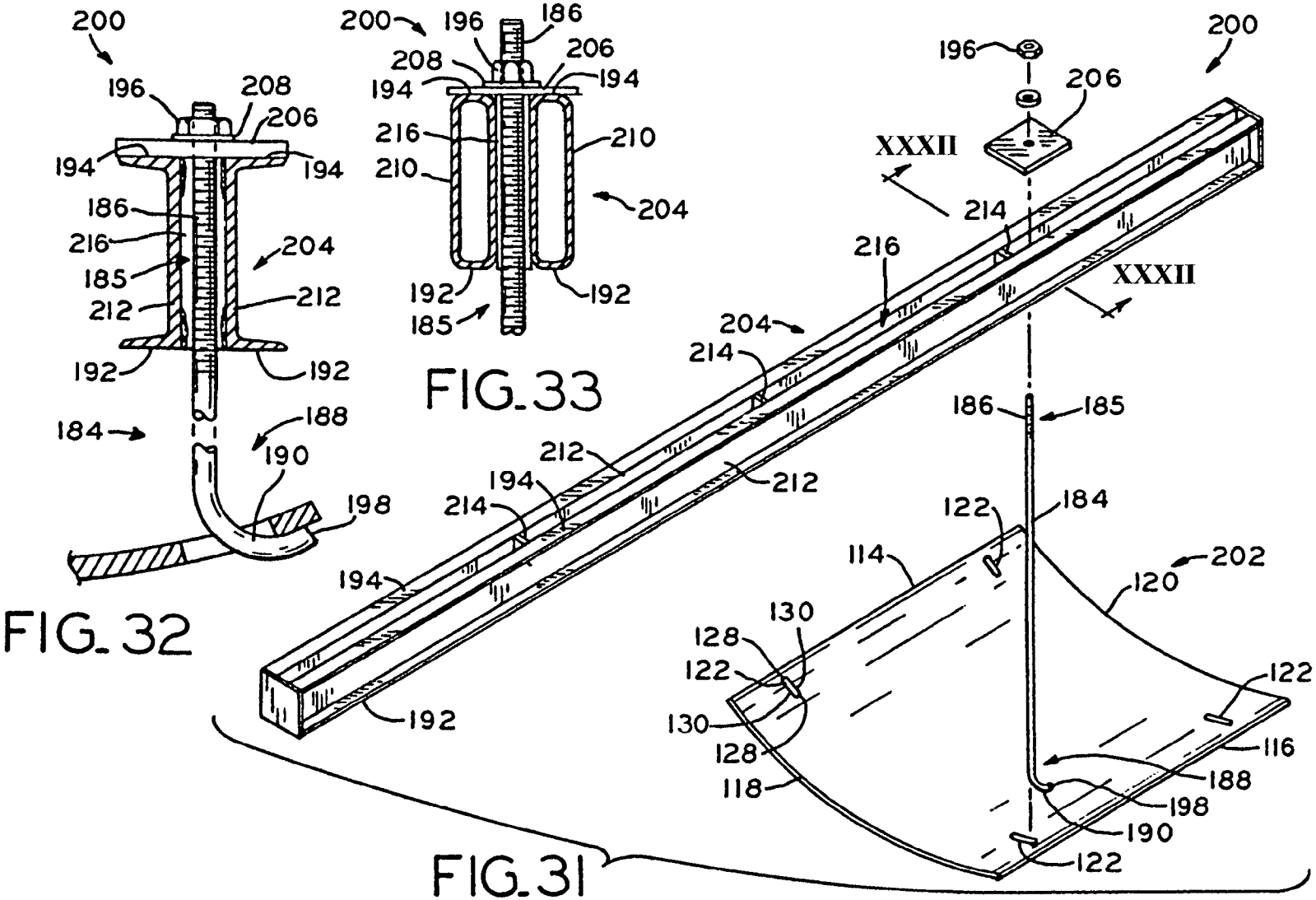
FIG. 31 is an exploded perspective view of a support system for curved sheet pile according to another exemplary embodiment.
FIG. 32 is a fragmentary, cross-sectional view of the support system of FIG. 31 taken along line 32-32 of FIG. 31.
FIG. 33 is a fragmentary, cross-sectional view of a support system according to another exemplary embodiment.

In another exemplary embodiment, support system 200 may be used to support sections of curved sheet pile 10, 112, 140, 150, 172. Support system 200 includes several components that are identical or substantially identical to support system 180 and identical reference numerals have been used to identify identical or substantially identical components therebetween. Referring to FIG. 31, an exploded view of support system 200 is shown including curved sheet pile 202. Curved sheet pile 202 has several features that are identical or substantially identical to corresponding features of curved sheet pile 112 and identical reference numerals have been used to identify identical or substantially identical features therebetween. Additionally, in other exemplary embodiments, curved sheet pile 202 may include features of curved sheet pile 140, such as flanges 132, 142. While support system 200 is described and depicted herein with specific reference to curved sheet pile 202, support system 200 may, as indicated above, be used with any curved sheet pile, such as curved sheet pile 10, 112, 140, 150, 172. Additionally, curved sheet pile 202 may also be used with any of the systems described herein, including support system 180 and pile drives 22, 52. As shown in FIG. 31, curved sheet pile 202 includes openings 122 that are rotated ninety degrees from the position shown with respect to curved sheet pile 112. Thus, J-hooks 190 may be inserted through openings 122 and positioned with ends 198 contacting a lower surface of curved sheet pile 202 without the need to rotate rods 184 ninety degrees to secure rods 184 to curved sheet pile 202.

Referring to FIGS. 31 and 32, support system 200 includes curved sheet pile 202, beams 204, rods 184, support plates 206, nuts 196, and washers 208. Beams 204 are formed from two adjacent sections of stringer, i.e., a horizontal, elongate member used as a support or connector. In one exemplary embodiment, beams 204 are formed from any two adjacent sections of stringer that may be combined to support the load of the curved sheet pile and subterranean material, such as two sections of channeling 212, i.e., a structural member having the form of three sides of a rectangle or square, as shown in FIG. 32. Alternatively, the stringer used to form beams 204 may be hollow bar stock 210, as shown in FIG. 33. Irrespective of the stringer used to form beams 204, e.g., bar stock 210 and/or channeling 212, the adjacent sections of stringer are spaced from one another by a distance defined by spacers 214 that are positioned between the adjacent sections of stringer and secured thereto. In one exemplary embodiment, spacers 214 are formed as steel plates and are welded to the adjacent sections of stringer to form beams 204. Spacers 214 cooperate with the adjacent sections of stringer to define opening or gap 216 therebetween. Gap 216 is sized to receive threaded ends 186 of rods 184 therethrough.

With J-hooks 190 positioned through openings 122 in curved sheet pile 202, threaded ends 186 of rods 184 are received within gap 216, such that a portion of threaded ends 186 extends above upper surfaces 194 of beams 204. Once in this position, threaded ends 186 are passed through opening 216 in support plates 206. Support plates 206 are sized to extend across gap 216 and to rest atop upper surfaces 194 of beams 204. Washers 208 are then received on threaded ends 186 and threaded nuts 196 threadingly engaged with threaded ends 186. Threaded nuts 196 are then advanced along threaded ends 186 in a direction toward upper surface 194 of beams 204 to capture support plates 206 between upper surfaces 194 of beams 204 and washers 208 and to secure curved sheet pile 202 to beams 204 via rods 184. This process may be repeated as necessary. Specifically, in one exemplary embodiment, curved sheet pile 202 is secured at each of openings 122 by rods 184 to beams 204.

Referring to FIG. 30, once the individual sections of curved sheet pile 10, 112, 140, 150, 172, 202 are effectively supported in position, an additional portion of trench 16 beneath sections of curved sheet pile 10, 112, 140, 150, 172, 202 may be excavated to form opening 48, to allow for the placement and/or repair of an additional conduit 50 beneath conduit 12. Once conduit 50 is properly installed and/or repaired, beams 182, 204 and rods 184 are removed from the individual sections of curved sheet pile 10, 112, 140, 150, 172, 202 and trench 16 is backfilled with subterranean material.

In order to properly insert sections of curved sheet pile 10, 112, 140, 150, 172, 202, a control system may be utilized. The control system may be substantially automatic and is designed to operate based on the location of conduit 12. Generally, cables are located in 12 inch by 18 inch raceways or conduits that are positioned an average of 5 feet below the ground surface. In some instances, recent survey information may be available. Depending on the age of the survey information, it may be necessary to verify the survey information, as a buried raceway, such as conduit 12, may move over time.

If a new survey is needed, a survey may be performed in one of several ways. For example a RTK GNNS receiver and data collector may be used to record the centerline of conduit 12. Alternatively, the measurements may be taken with a total station. As locating conduit 12 may be difficult, it is also possible to do the surveying after forming trench 16.

To locate conduit 12 remotely, several methods may be used. For example, a cable detector may be added to a survey system. Alternatively, ground penetrating radar may be used. The selection of the system for locating the raceways should be based on the size of the job and the time available. Generally, the surveyor can carry the equipment, the equipment may be mounted to an all terrain vehicle, or the equipment may mounted to a traditional vehicle. Once the data is collected, the data may be transmitted to a server using, for example, a GPRS/3G connection.

With the survey data collected, a three dimensional design for the control system is created. Additionally, if the survey data is forming a solid centerline, the three dimensional design can be done using an onboard control system, such as the onboard control system of excavator 20. If the three-dimensional design is not created using the onboard control system of excavator 20, the final design is uploaded to the onboard control system of excavator 20.

In addition to the centerline and/or outline of conduit 12, exclusion zones can be added to the three-dimensional design. For example, an exclusion zone, such as exclusion zone 14 depicted by a circle in FIG. 1, may be added to prevent damage to conduit 12. Thus, the exclusion zone should be designed such that piles 10, 112, 140, 150, 172, 202 are positioned far enough away from conduit 12 that no damage to conduit 12 occurs during insertion.

Based on the accuracy of the three-dimensional design data, a rough or accurate trench, such as trench 16 shown in FIG. 1, will be excavated to one side of conduit 12. The control system will guide the operator through a three-dimensional view and/or a map-display and indicate to the operator both where to dig and how deep to dig. In one exemplary embodiment, the following information is available to the operator on the system screen of the control system: the trench profile and placement, the raceway model, and exclusion zone 14. In one exemplary embodiment, the raceway model is simply a depiction of conduit 12 on the system screen of the control system. Similarly, exclusion zone 14 is depicted as a circle or other geometric figure surrounding the raceway model. Additionally, in one exemplary embodiment, the operator may be able to adjust the size of exclusion zone 14, the profile of exclusion zone 14, and/or other properties of three-dimensional model. Alternatively, in other exemplary embodiments, the operator may be prohibited from making these or other modifications to the three-dimensional design.

Once trench 16 is formed, manual evaluation of the position of conduit 12 relative to trench 16 should be performed. This ensures the accuracy of the model, i.e., that conduit 12 is actually positioned as indicated in the model. Once the position of conduit 12 is confirmed, pile sheets 10, 112, 140, 150, 172, 202 may be positioned beneath conduit 12 as described in detail above. With an individual pile sheet 10, 112, 140, 150, 172, 202 grasped by vibratory pile driver 20, the machine control system will guide the sheet into the right position and orientation. For example, after pile 10, 112, 140, 150, 172, 202 has been preliminarily positioned by the operator, the operator activates the automatic control system and the system maneuvers pile 10, 112, 140, 150, 172, 202 along its calculated trajectory. Specifically, the automatic control system will ensure that excavator 20 manipulates vibratory pile driver 22, 52 as needed to advance individual pile 10, 112, 140, 150, 172, 202 about an arcuate path that has substantially the same radius of curvature as the radius of curvature of pile 10, 112, 140, 150, 172, 202. Additionally, individual sheets 10, 112, 140, 150, 172, 202 may be positioned and advanced to interlock with one another.

In one exemplary embodiment, the control system is a distributed control system in which the sensors that determine the position of pile driver 22, 52 and the valve controllers that operate pile driver 22, 52 and articulated boom 24 of excavator 20 are connected to a display unit over a field bus, such as a CANopen bus. Additionally, the system master display unit is a display unit with a sufficient amount of random access memory, mass memory, a central processing unit, and graphical processing capabilities.

In order to determine the position of excavator 20, as needed to maneuver piles 10, 112, 140, 150, 172, 202 into position, a GNSS antenna may be used. In one exemplary embodiment, a single antenna system is used in which a machine heading is obtained by rotation of the machine body. Specifically, as the machine body rotates, the GNSS antenna creates an arc and/or ellipse depending on the plane orientation. From the arc and/or ellipse, a rotation center can be calculated and, as long as the machine is not moved, a direction from the current GNSS antenna to the rotation center of the arc and/or ellipse can be solved. From that, the actual heading of the machine can be determined.

In another exemplary embodiment, a dual antenna system is used. In this system, two antennas are positioned on excavator 20 and the direction between the antennas is constantly calculated. This provides a constant update on the relative position of the machine. Additionally, in other exemplary embodiments, three or more antenna systems can be used. In these cases, in addition to the direction of the machine, the pitch and the roll of the machine body can be calculated. In other exemplary embodiments, the pitch and the roll of the machine body is calculated using a single dual-axis inclinometer. In another exemplary embodiment, a robotic total station can be used instead of a GNSS system to determine the three-dimensional positioning of excavator 20.

In order to determine the position of vibratory pile drivers 22, 52, 2-D sensors may be used. In one exemplary embodiment, attachment sensors are positioned to determine the rotation of vibratory pile driver 22, 52 about second body axis of rotation $BA_2$, shown in FIG. 7. Additionally, a dual axis inclinometer may be used to determine the roll and tilt of pile driver 22, 52. By utilizing an attachment rotation sensor, information may be collected that helps to compensate for the pitch and the roll of excavator 20. Additionally, in order to increase accuracy, the dual axis inclinometer may be replaced by two separate encoders or absolute angle sensors. Thus, the pile driver has 360° of freedom of movement to enable clamps 45, 106 of pile drivers 22, 52, respectively, to be positioned in direct alignment with sheet pile 10, 112, 140, 150, 172, 202.

In order to control the actuation of excavator 20 and, correspondingly, pile driver 22, 52, valve controllers may be used. The valve controllers may be actuated to control the trajectory of the insertion of piles 10, 112, 140, 150, 172, 202. Based on the sensor data identified above and the planned path for pile 10, 112, 140, 150, 172, 202, the system calculates target angle values for the next "time slot". This method of calculation is also referred to as inverse kinematics. Thus, the trajectory of the inserted piles 10, 112, 140, 150, 172, 202 should be perpendicular to the longitudinal axis of the raceway. In three dimensions, there are an infinite number of vectors that are perpendicular to any given vector, all satisfying the equation $\alpha \cdot \alpha^1 = 0$. This system is designed to identify the vectors that are on the same plane defined partly by conduit 12 and advances piles 10, 112, 140, 150, 172, 202 along the same. Additionally, a height offset may be need. The height offset is essentially a copy of the raceway centerline moved to a different point on the Z-axis according to exclusion zone 14 and/or the planned distance between conduit 12 and the sheet pile. Thus, utilizing the desired vector and height offset, piles 10, 112, 140, 150, 172, 202 may be advanced into their desire positions substantially automatically utilizing a total control system.

Alternatively, with an area adjacent to the conduit that is sufficiently excavated, planar sheet pile may be driven horizontally underneath the conduit and secured together, such as with interlocking features defined by the planar sheet pile, to provide support to the conduit.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A support system for supporting a conduit positioned underground, comprising:

a section of curved sheet pile adapted to be driven underneath the conduit buried underground, said section of curved sheet pile comprising:

a body having an upper surface, a lower surface, a gripping edge, a leading edge, and opposing side edges extending between said gripping edge and said leading edge, said body having a constant radius of curvature extending from said gripping edge to said leading edge, said gripping edge, said leading edge, and said opposing side edges cooperating to define a perimeter of said body;

a first opening positioned adjacent to said gripping edge of said body and extending between said upper surface and said lower surface of said body; and a second opening positioned adjacent to said leading edge of said body and extending between said upper surface and said lower surface of said body;

a first elongate suspension member having a pile connection end and a beam end, said pile connection end configured to pass through said first opening in said curved sheet pile for connection of said first elongate suspension member to said section of curved sheet pile; and at least one beam, wherein said beam connection end of said first elongate suspension member is connectable to said at least one beam.

2. The support system of claim 1, wherein said at least one beam further comprises an opening in said at least one beam, said beam connection end of said first elongate suspension member sized to pass through said opening in said at least one beam, wherein, with said first elongate suspension member extending at least partially through said opening in said at least one beam, said beam connection end connected to said at least one beam.

3. The support system of claim 1, wherein said pile connection end of said first elongate suspension member comprises a J-hook and said beam connection end of said first elongate suspension member comprises a threaded portion.

4. The support system of claim 3, wherein said support system further comprises a nut sized to threadingly engage said threaded portion of said first elongate suspension member.

5. The support system of claim 4, where said support system further comprises a plate having an opening extending therethrough, said plate configured for receipt of said threaded portion of said first elongate suspension member, wherein said plate is captured between an upper surface of said at least one beam and said nut.

6. The support system of claim 1, wherein said beam further comprises adjacent sections of stringer and a plurality of spacers, said spacers extending between said adjacent sections of stringer to connect said adjacent sections of stringer together, wherein said spacers cooperate with said adjacent sections of stringer to define the opening in said at least one beam.

7. A support system for supporting a conduit positioned underground, comprising:

a section of curved sheet pile adapted to be driven underneath a conduit buried underground, said section of curved sheet pile comprising:

a body having an upper surface, a lower surface, a gripping edge, a leading edge, and opposing side edges extending between said gripping edge and said leading edge, said body having a constant radius of curvature extending from said gripping edge to said leading edge, said gripping edge, said leading edge, and said opposing side edges cooperating to define a perimeter of said body; and a first flange extending from one of said opposing sides of said body, said first flange offset from said upper surface of said body;

a first elongate suspension member having a pile connection end and a beam end, said pile connection end is configured for connection to said section of curved sheet pile; and at least one beam, wherein said beam connection end of said first elongate suspension member is configured for connection to said at least one beam.

8. The support system of claim 7, wherein said section of curved sheet pile further comprises a second flange extending from one of said opposing side edges of said body opposite from said first flange, said second flange offset from said upper surface of said section of curved sheet pile.

9. The support system of claim 7, wherein said pile connection end of said first elongate suspension member comprises a J-hook and said beam connection end of said first elongate suspension member comprises a threaded portion.

10. The support system of claim 9, wherein said support system further comprises a nut sized to threadingly engage said threaded portion of said first elongate suspension member.

11. The support system of claim 10, where said support system further comprises a plate having an opening extending therethrough, said plate configured for receipt on said threaded portion of said first elongate suspension member, wherein said plate is captured between an upper surface of said at least one beam and said nut.

12. The support system of claim 7, wherein said at least one beam further comprises an opening, said beam connection end of said first elongate suspension member sized to pass through said opening in the at least one beam, wherein, with said first elongate suspension member extending at least partially through said opening in said at least one beam, said beam connection end connected to said at least one beam.

13. The support system of claim 7, wherein said at least one beam further comprises adjacent sections of stringer and a plurality of spacers, said spacers extending between said adjacent sections of stringer to connect said adjacent sections of stringer together, wherein said spacers cooperate with said adjacent sections of stringer to define an opening in said at least one beam.

* * * * *